US011568684B2

(12) United States Patent
Saito et al.

(10) Patent No.: US 11,568,684 B2
(45) Date of Patent: Jan. 31, 2023

(54) CONTROL UNIT AND CONTROL SYSTEM FOR VEHICLE

(71) Applicant: Robert Bosch GmbH, Stuttgart (DE)

(72) Inventors: Toshihiro Saito, Kanagawa (JP); Kenji Arai, Kanagawa (JP); Yuki Shimoya, Kanagawa (JP)

(73) Assignee: Robert Bosch GmbH, Stuttgart (DE)

( * ) Notice: Subject to any disclaimer, the term of this patent is extended or adjusted under 35 U.S.C. 154(b) by 296 days.

(21) Appl. No.: 16/642,155

(22) PCT Filed: Jul. 19, 2018

(86) PCT No.: PCT/IB2018/055367

§ 371 (c)(1),
(2) Date: Feb. 26, 2020

(87) PCT Pub. No.: WO2019/043471

PCT Pub. Date: Mar. 7, 2019

(65) Prior Publication Data

US 2021/0074081 A1 Mar. 11, 2021

(30) Foreign Application Priority Data

Aug. 29, 2017 (JP) ..... JP2017-164825

(51) Int. Cl.
*G07C 5/00* (2006.01)
*G07C 5/08* (2006.01)

(52) U.S. Cl.
CPC ..... *G07C 5/006* (2013.01); *G07C 5/085* (2013.01); *G07C 5/0808* (2013.01)

(58) Field of Classification Search
CPC ..... G07C 5/006; G07C 5/0808; G07C 5/085
See application file for complete search history.

(56) References Cited

U.S. PATENT DOCUMENTS

2008/0208533 A1 8/2008 Yokogawa
2009/0105903 A1 4/2009 Iwai
2010/0292892 A1 11/2010 Enomoto et al.
2010/0324777 A1* 12/2010 Tominaga ..... G07C 5/0808 701/31.4

FOREIGN PATENT DOCUMENTS

JP 2000145533 5/2000
JP 2006199096 8/2006

OTHER PUBLICATIONS

International Search Report for Application No. PCT/IB2018/055367 dated Oct. 4, 2018 (English Translation, 3 pages).

* cited by examiner

*Primary Examiner* — Michael V Kerrigan
(74) *Attorney, Agent, or Firm* — Michael Best & Friedrich LLP

(57) ABSTRACT

The invention provides a control unit and a control system for a vehicle capable of reducing a workload of deleting a record of information of an unintended event detected by a certain control unit by preventing the other control unit from recording the information of the event. Control units (50a to 50d) that are mounted on the vehicle and connected in a mutually communicable manner each include an event processing section (55). The event processing section (55) executes one or both of processing to switch whether to notify a recording request of the information of the event and processing to switch necessity/unnecessity of recording of the information of the event.

6 Claims, 16 Drawing Sheets

[Fig. 1]
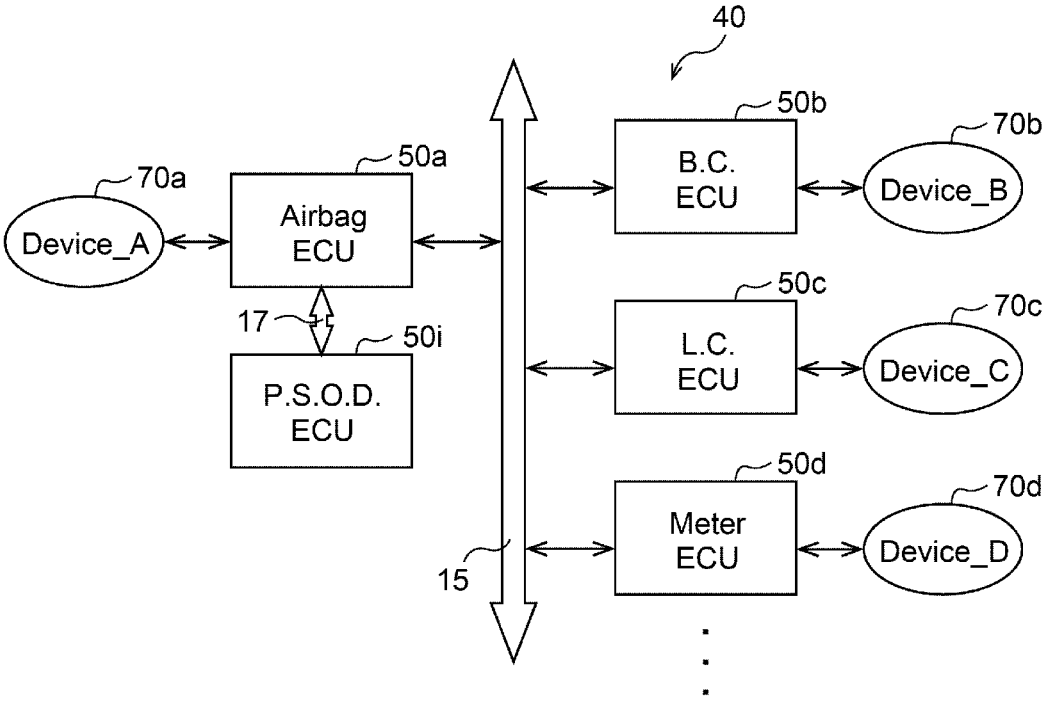
[Fig. 2]
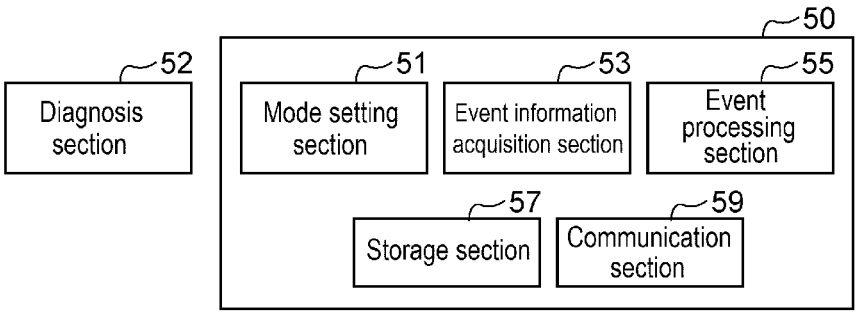

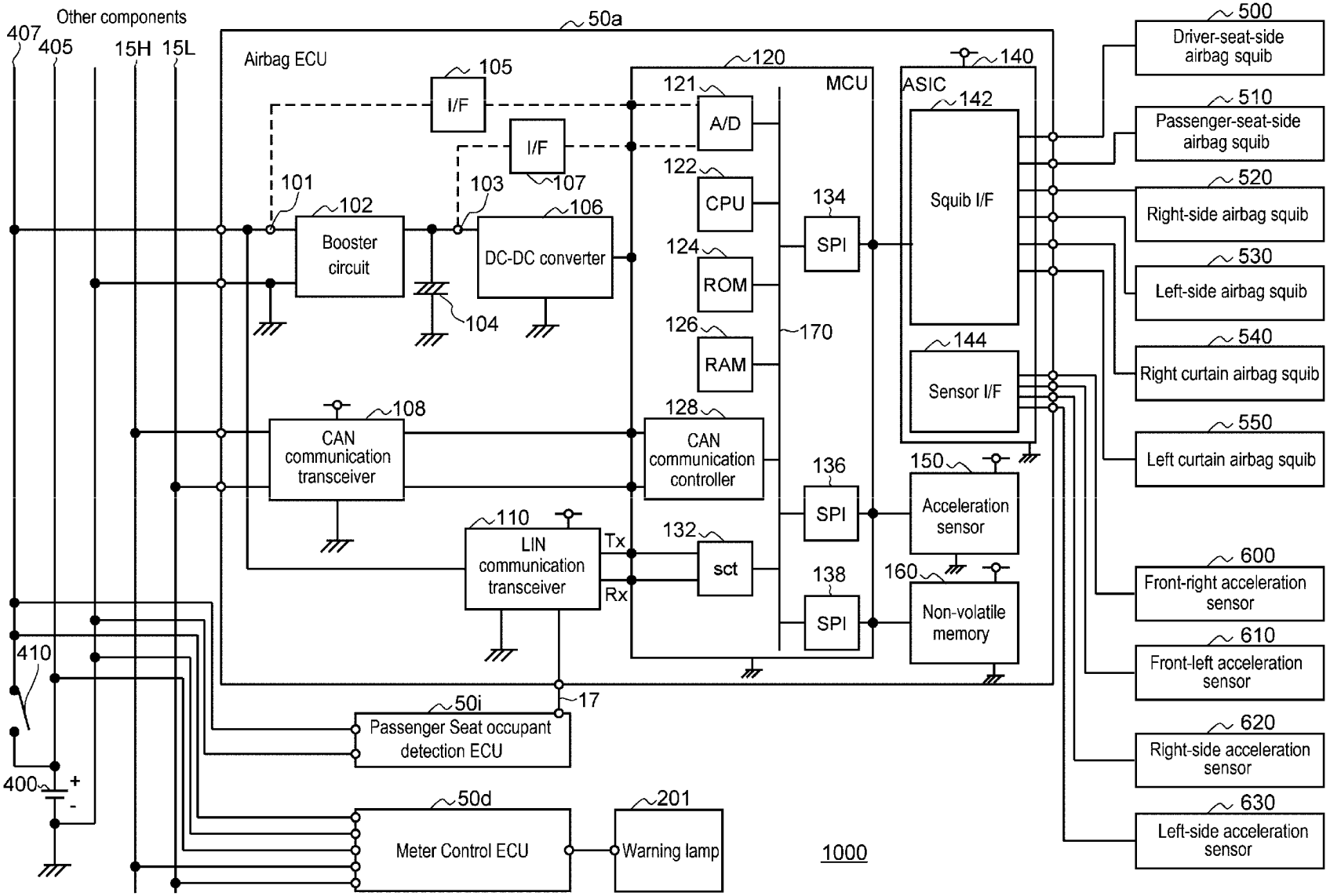
[Fig. 3]

[Fig. 4]

| Event | Host control unit | |
|---|---|---|
| | Market mode | Other than market mode |
| Communication disruption | Transmission necessary | Transmission unnecessary |
| Abnormality detection | Transmission necessary | Transmission unnecessary |
| Abnormality recovery | Transmission necessary | Transmission unnecessary |
| Failure confirmation | Transmission necessary | Transmission unnecessary |
| Failure recovery | Transmission necessary | Transmission unnecessary |
| EOL inexecution | Transmission necessary | Transmission unnecessary |
| Manufacturing malfunction | Transmission unnecessary | Transmission necessary |
| Collision phenomenon detection | Transmission necessary | Transmission unnecessary |
| Airbag deployment | Transmission necessary | Transmission unnecessary |
| Collision processing completion | Transmission necessary | Transmission unnecessary |
| Collision recording initiation | Transmission necessary | Transmission unnecessary |

[Fig. 5]

| Event | Other control units | |
|---|---|---|
| | Market mode | Other than market mode |
| Communication disruption | Recording necessary | Recording unnecessary |
| Abnormality detection | Recording necessary | Recording unnecessary |
| Abnormality recovery | Recording necessary | Recording unnecessary |
| Failure confirmation | Recording necessary | Recording unnecessary |
| Failure recovery | Recording necessary | Recording unnecessary |
| EOL inexecution | Recording necessary | Recording unnecessary |
| Manufacturing malfunction | Recording unnecessary | Recording necessary |
| Collision phenomenon detection | Recording necessary | Recording unnecessary |
| Airbag deployment | Recording necessary | Recording unnecessary |
| Collision processing completion | Recording necessary | Recording unnecessary |
| Collision recording initiation | Recording necessary | Recording unnecessary |

[Fig. 6]
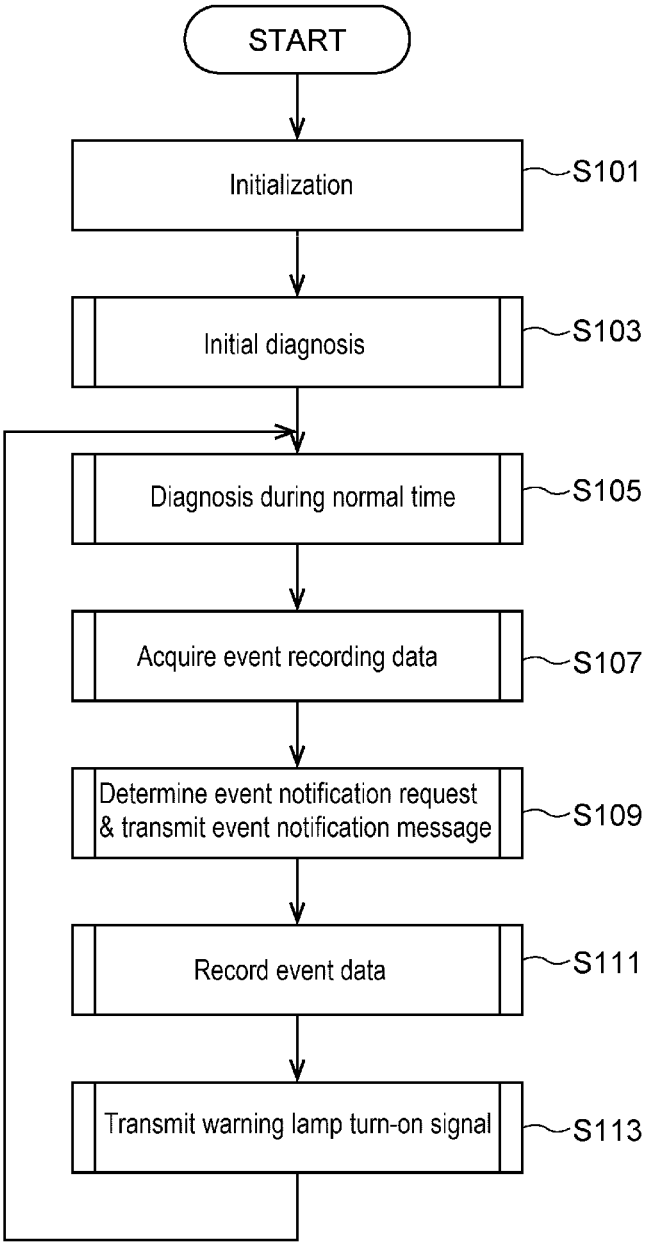

[Fig. 7]
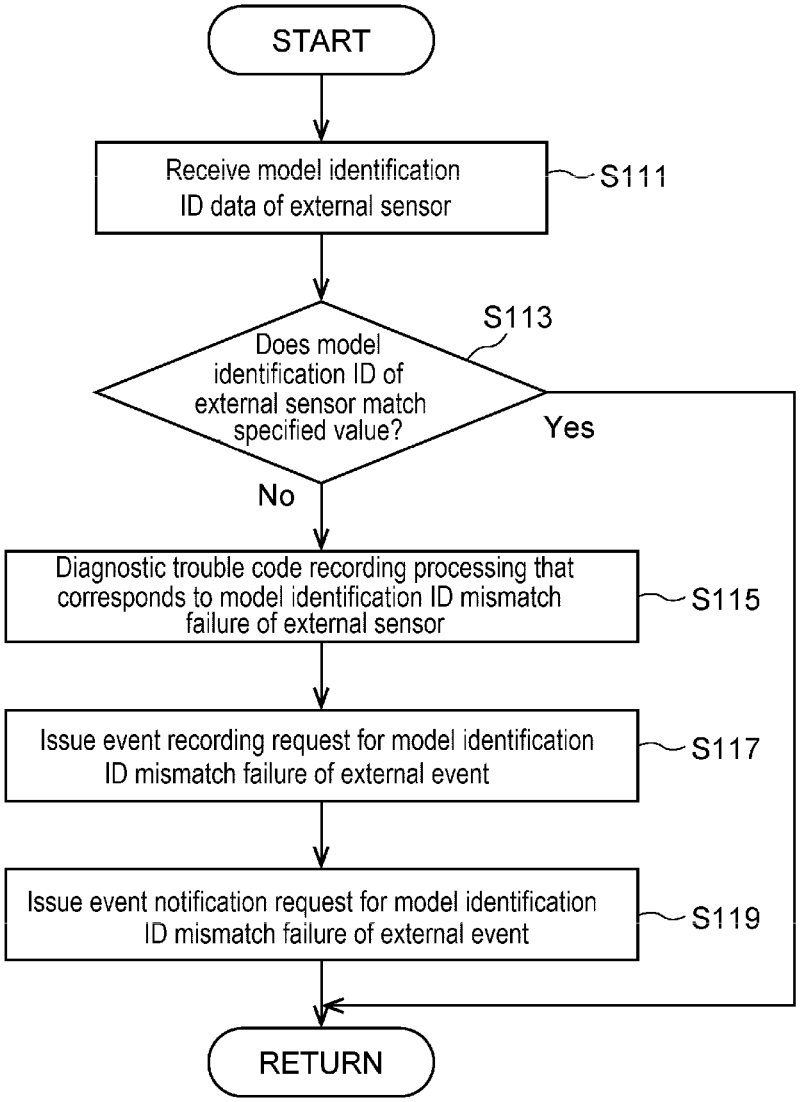

[Fig. 8]
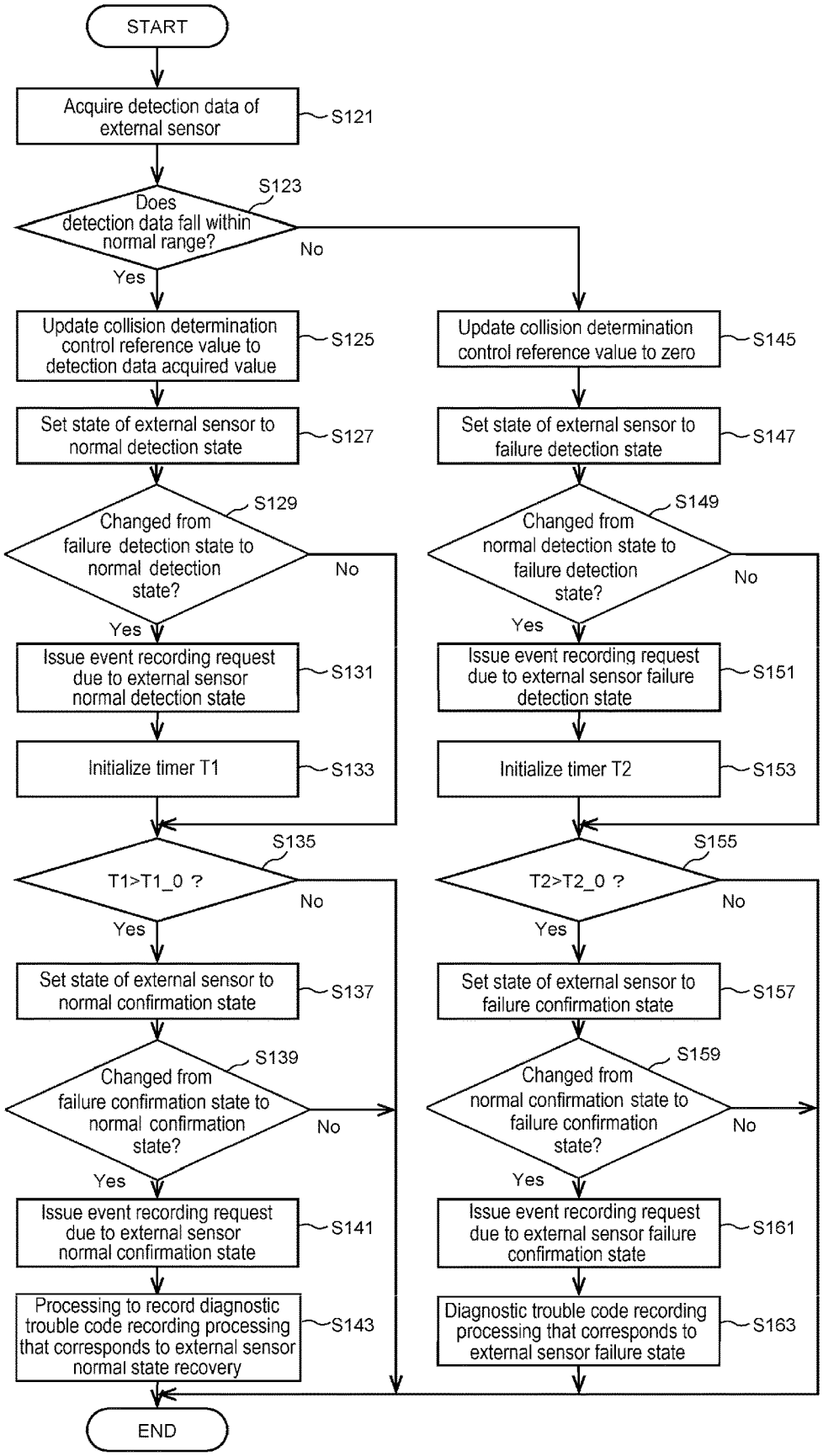

[Fig. 9]
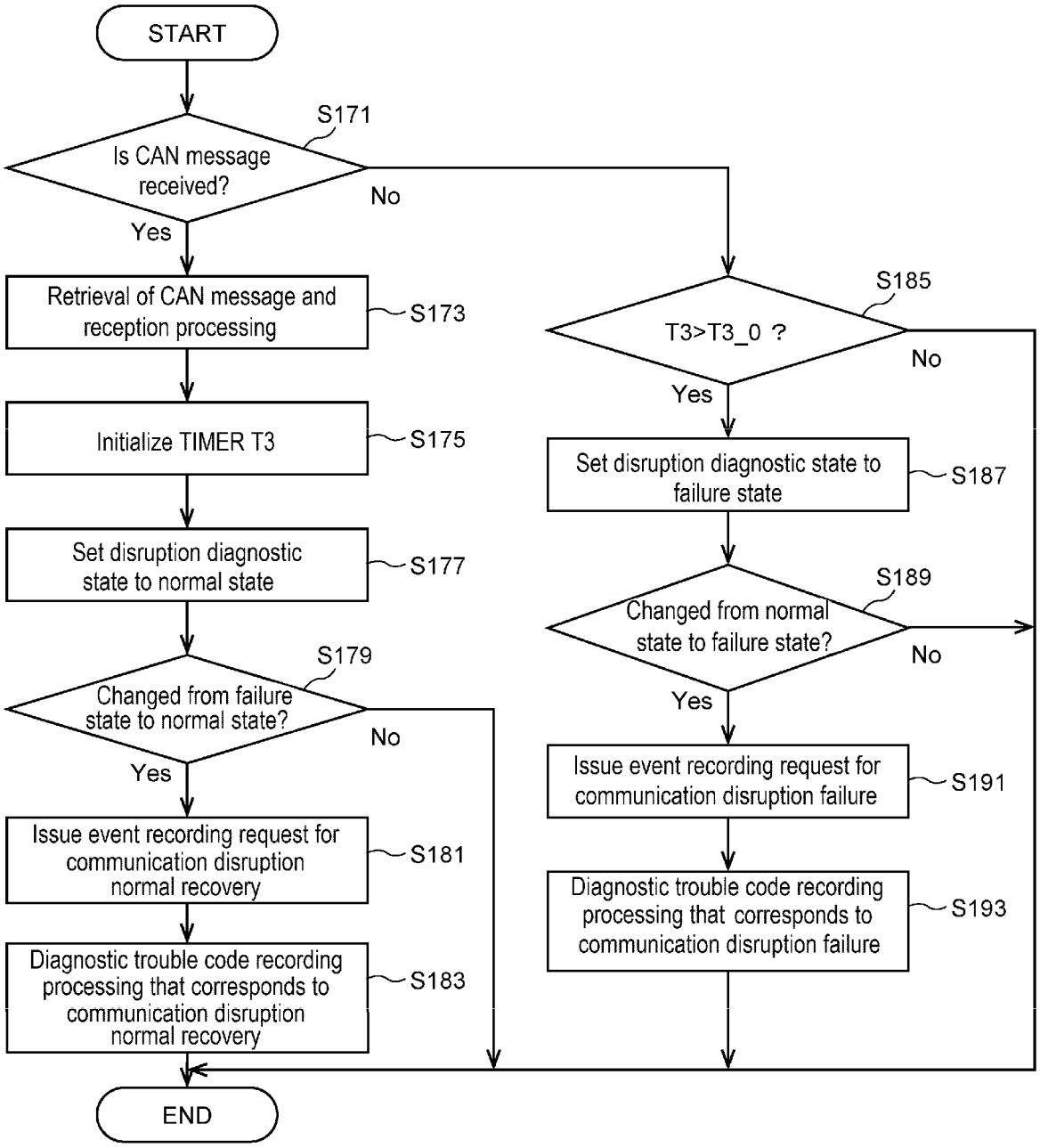

[Fig. 10]
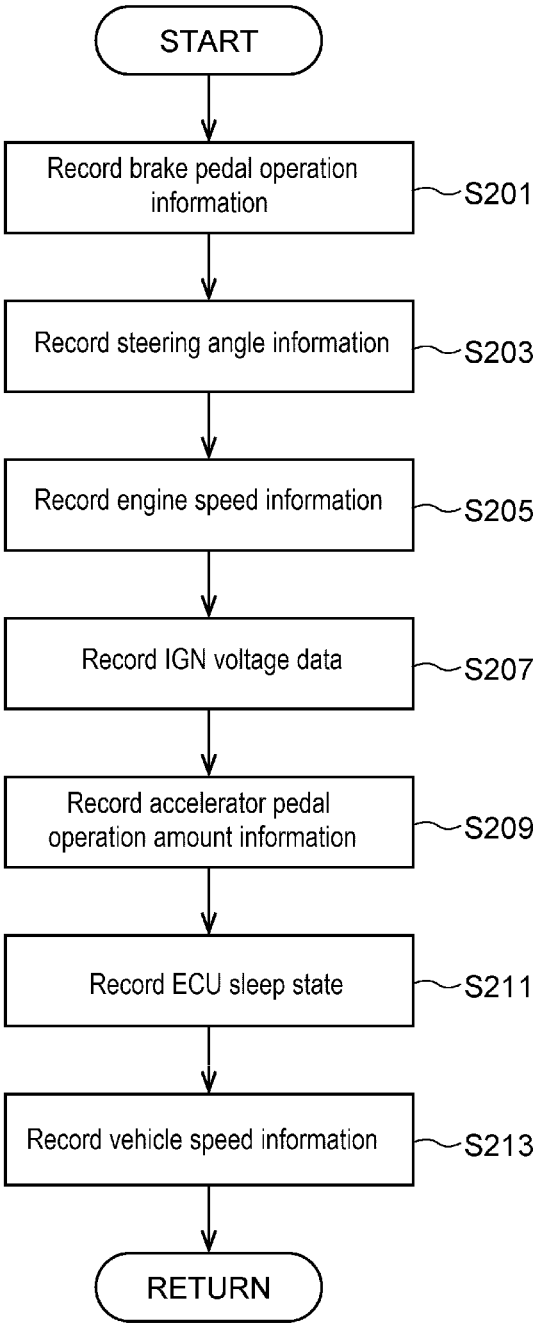

[Fig. 11]
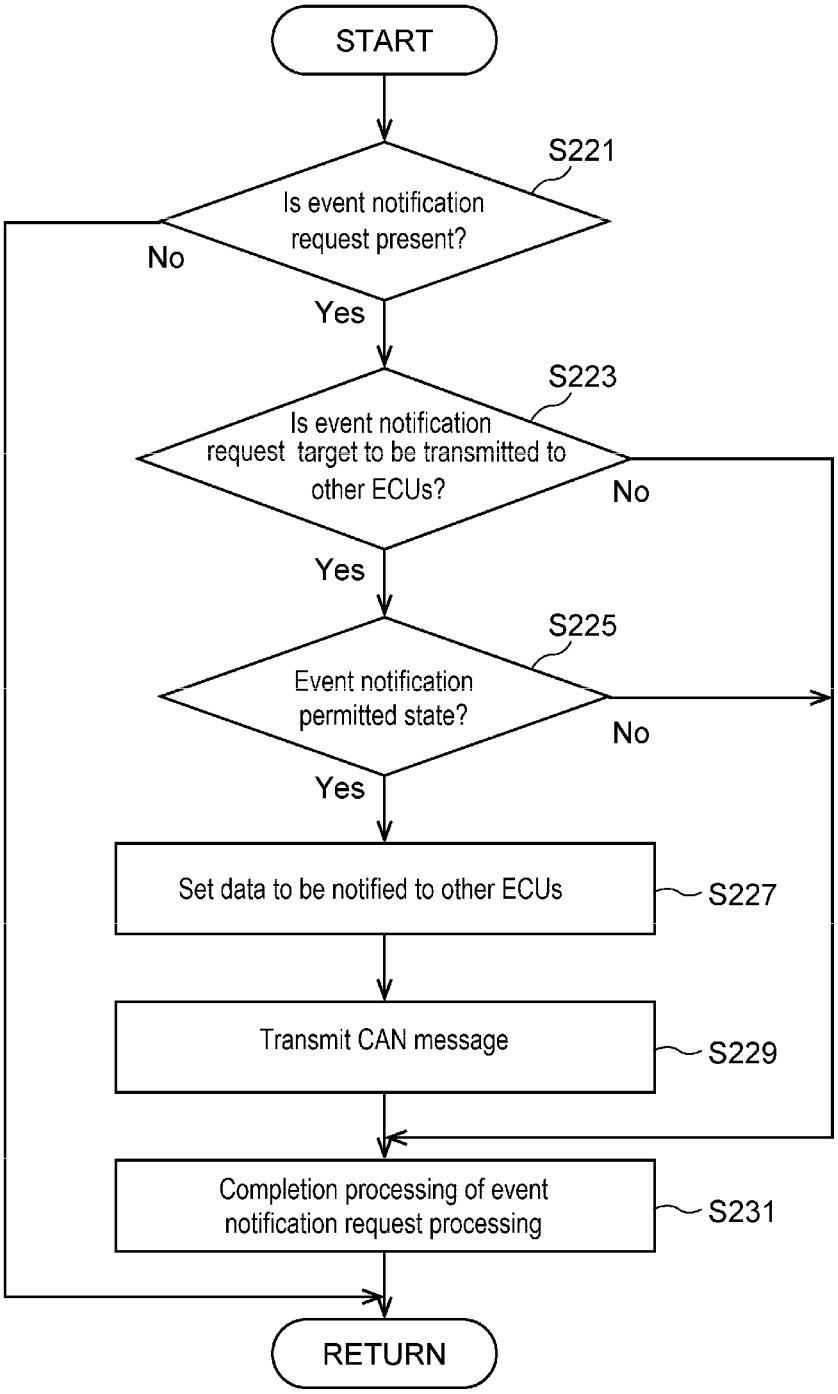

[Fig. 12]
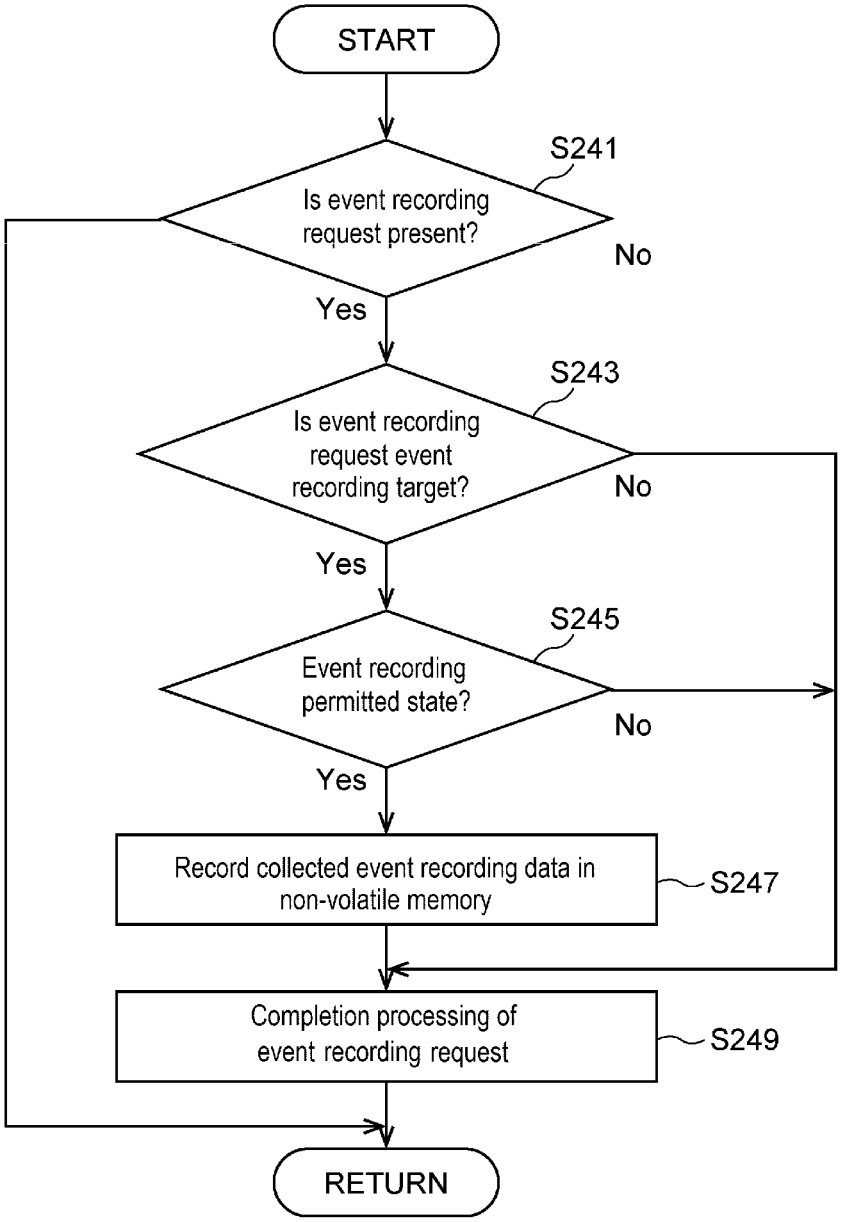

[Fig. 13]
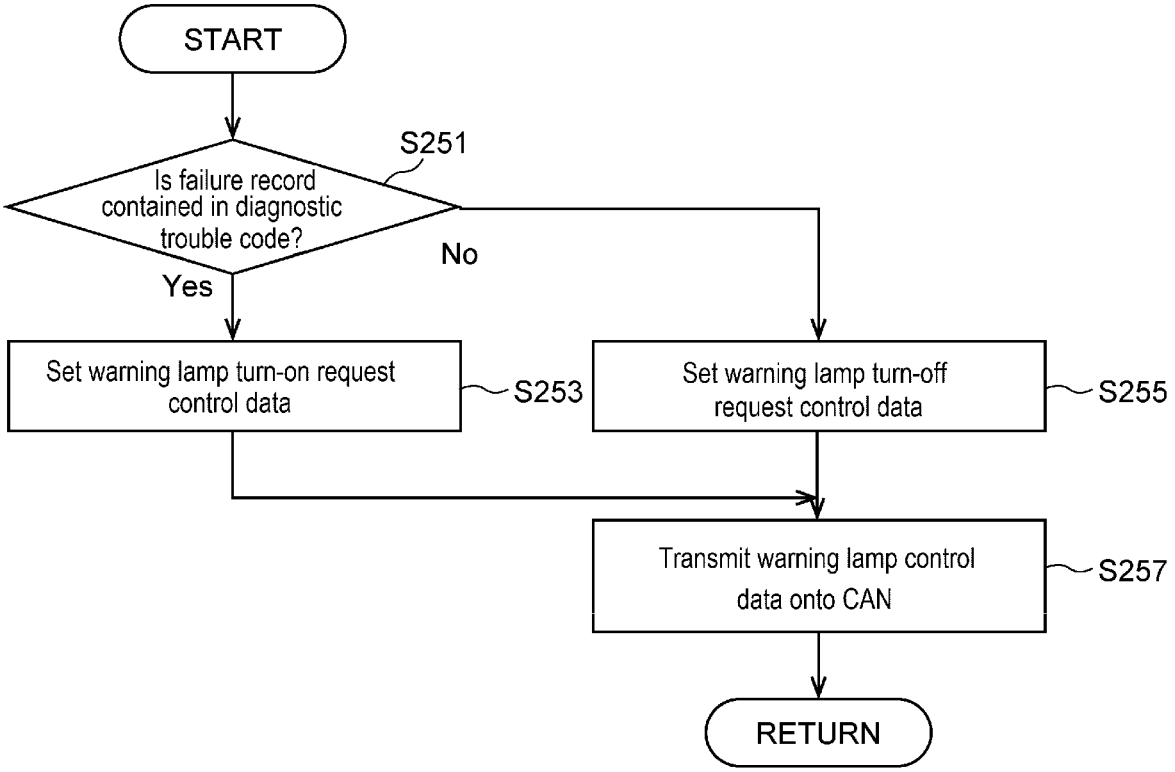
[Fig. 14]
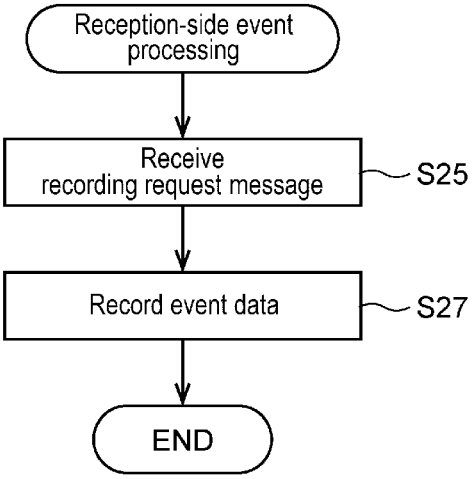

[Fig. 15]
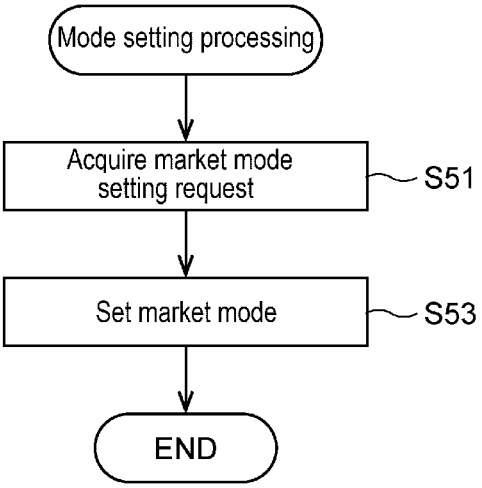
[Fig. 16]
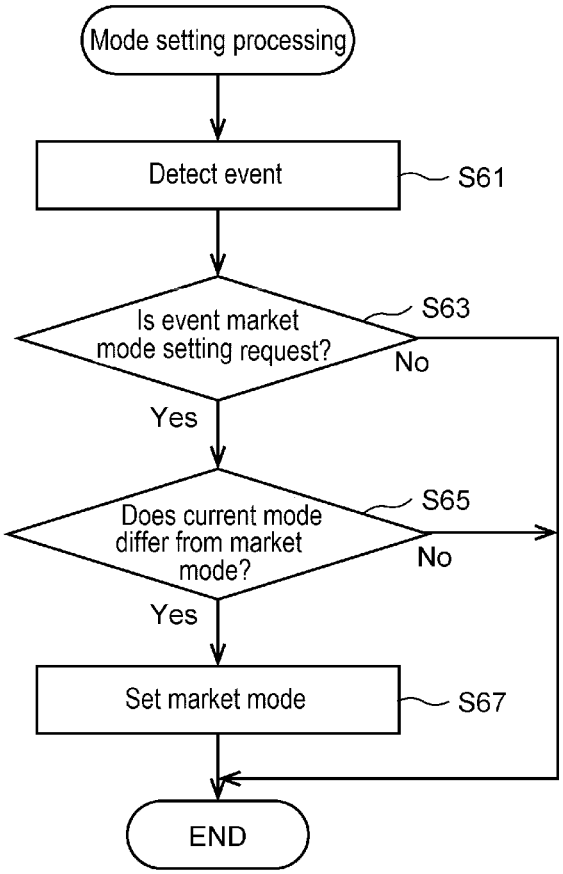

[Fig. 17]
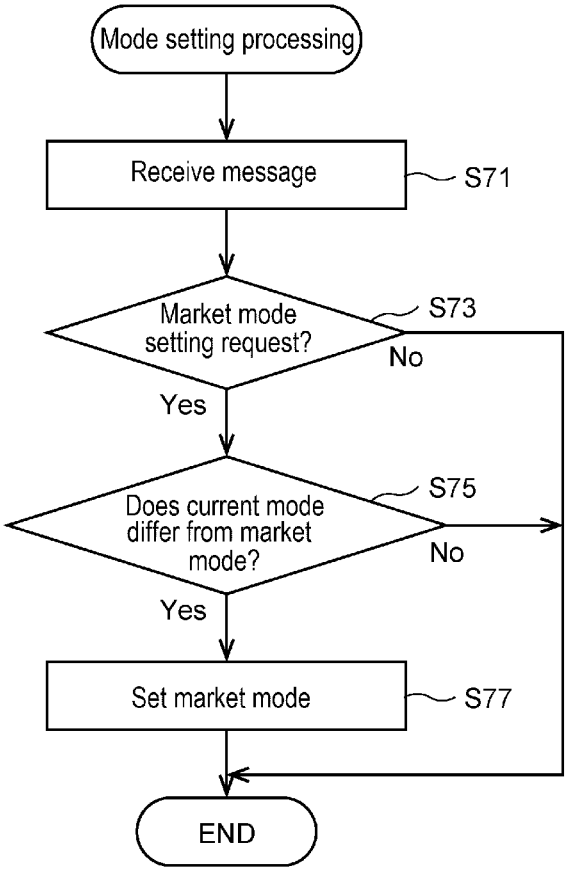
[Fig. 18]
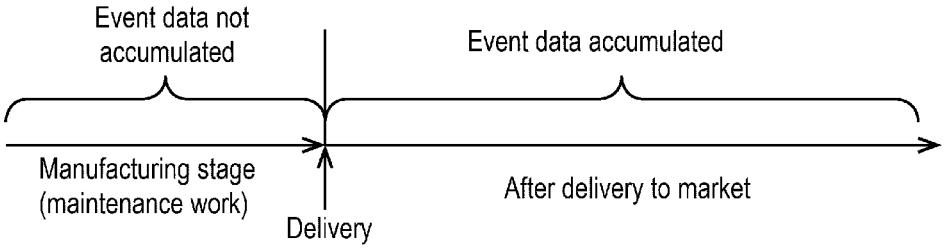

[Fig. 19]
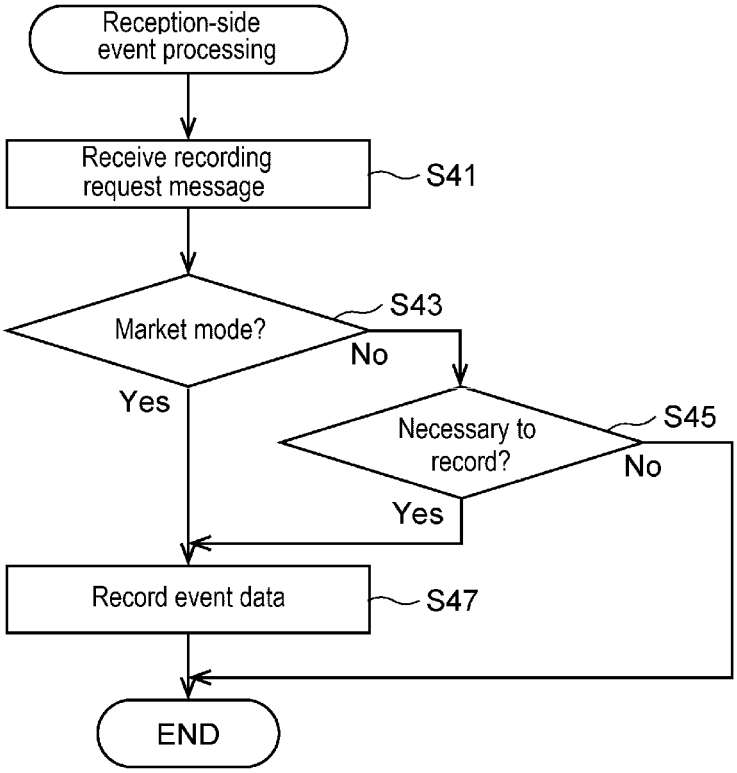
[Fig. 20]
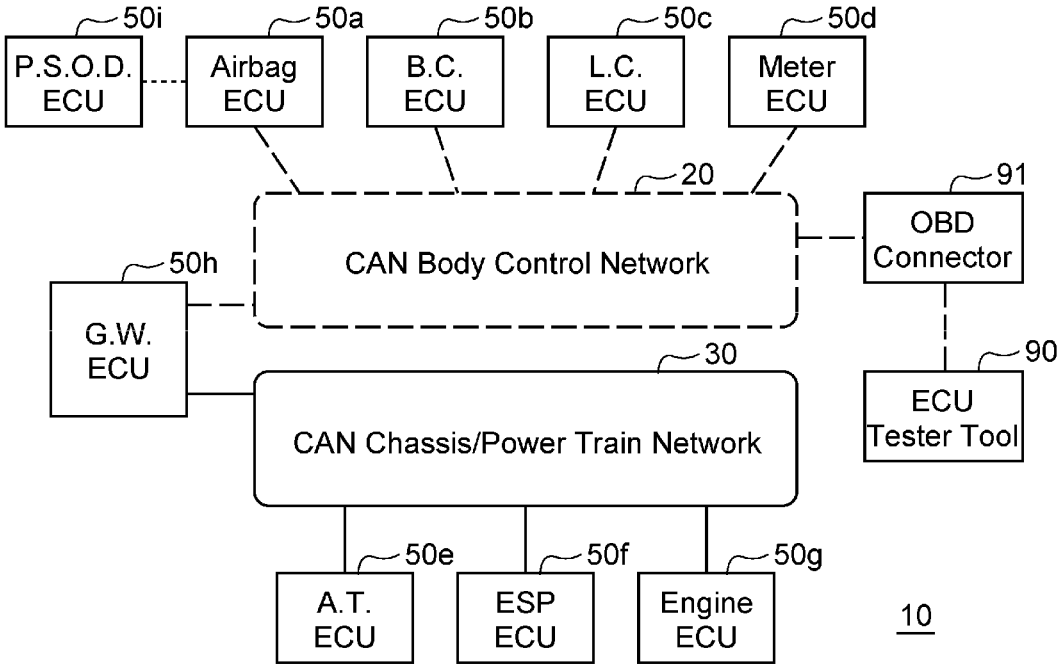

[Fig. 21]
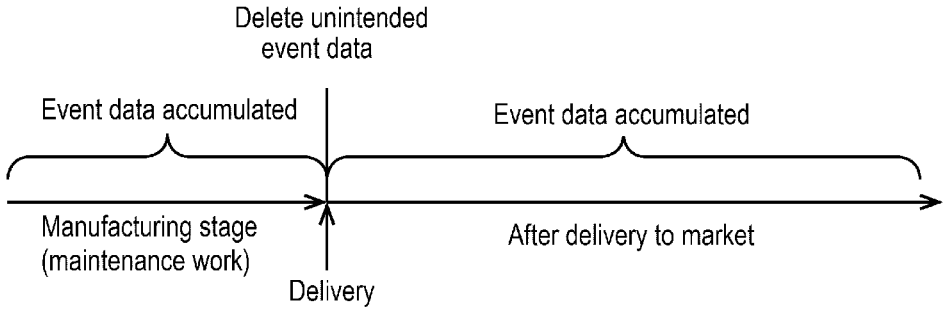

CONTROL UNIT AND CONTROL SYSTEM FOR VEHICLE

BACKGROUND OF THE INVENTION

The invention relates to a control unit that is mounted on a vehicle and to a control system for a vehicle.

Conventionally, in control of a vehicle such as an automobile, a technique of analyzing a phenomenon (an event) such as failure detection that occurs after manufacturing of a vehicle by using plural control units that are connected to each other in a mutually communicable manner has been known. For example, JP-A-2000-145533 and JP-A-2006-199096 each disclose a technique in which the control unit that detects the event transmits an event recording request to the other control unit and the other control unit records information of the event on the basis of received information.

According to the technique disclosed in each of JP-A-2000-145533 and JP-A-2006-199096, for example, it is possible to refer to not only an event report that includes explanation of a peripheral situation and the like by an occupant such as a driver at the time when the failure occurs but also a record in the control unit that has recorded the information of the event. At the time, not only the control unit that detects the event but also the other control unit stores the record of the information of the event. Thus, a detailed analysis of the event can be made.

SUMMARY OF THE INVENTION

However, in the technique disclosed in each of JP-A-2000-145533 and JP-A-2006-199096, the control unit also detects the events that occur at times other than normal use of the vehicle such as the event occurred in an assembly process of the vehicle and the event occurred during repair maintenance work of the vehicle. The control unit that detects such an event transmits the event recording request to the other control unit, and the other control unit records the information of the event.

That is, the plural control units record the information of the event under the following environment. It is anticipated that the several control units inevitably detect the event in a situation where the vehicle is not used by a user such as the assembly process of the vehicle or during the repair maintenance work of the vehicle.

The information of the event that is recorded at the time includes information other than target information, recording of which is originally intended. Thus, after completion of the assembly or after completion of maintenance work, it is necessary to delete the recorded information of the event.

In recent years, there is an increasing tendency of the number of the control units that are mounted on the vehicle due to advancement of vehicle control such as cooperative control of an engine and a brake and automatic drive control. With an increase in the number of the on-board control units, such opportunities that the control units mutually request recording of the information are also increased.

Thus, time required for a task of deleting the event information that is recorded in the control units is increased proportionally. This possibly leads to an increase in vehicle manufacturing cost and an increase in repair cost due to an increase in work hours at a repair shop.

The invention has been made with the above as the background and therefore has a purpose of providing a control unit and a control system for a vehicle capable of reducing a workload of deleting a record of information of an unintended event detected by a certain control unit by preventing the other control unit from recording the information of the event.

According to one aspect of the invention, in a set of control units that are mounted on a vehicle and connected in a mutually communicable manner, the control units each include an event processing section, and the event processing section executes one or both of processing to switch whether to notify a recording request of information of an event and processing to switch necessity/unnecessity of recording the information of the event.

In addition, according to another aspect of the invention, in a control system for a vehicle including plural control units that are connected in a mutually communicable manner, the control units each include an event processing section, and the event processing section executes one or both of processing to switch whether to notify a recording request of information of an event and processing to switch necessity/unnecessity of recording the information of the event.

As it has been described so far, according to the invention, a workload of deleting a record of the unintended event detected by the certain control unit can be reduced by preventing the other control unit from recording information of the event.

BRIEF DESCRIPTION OF THE DRAWINGS

FIG. 1 is a schematic view of an overall configuration example of a control system for a vehicle according to an embodiment of the invention.

FIG. 2 is a block diagram of a fundamental configuration example of a control unit according to the embodiment.

FIG. 3 is a diagram illustrating a configuration example of an airbag control system.

FIG. 4 is a table illustrating a setting example of necessity/unnecessity of transmitting a recording request by the control unit.

FIG. 5 is a table illustrating a setting example of necessity/unnecessity of recording by other control units.

FIG. 6 is a flowchart that schematically illustrates a processing operation of a control unit according to a first implementation.

FIG. 7 is a flowchart of initial diagnostic processing by the control unit.

FIG. 8 is a flowchart of external sensor failure diagnostic processing as one example of a diagnosis during normal time by the control unit.

FIG. 9 is a flowchart of message communication disruption diagnostic processing as another example of the diagnosis during the normal time by the control unit.

FIG. 10 is a flowchart of event recording data acquisition processing by the control unit.

FIG. 11 is a flowchart of processing to determine an event notification request and transmit a message by the control unit.

FIG. 12 is a flowchart of event data recording processing by the control unit.

FIG. 13 is a flowchart of warning lamp turn-on processing by the control unit.

FIG. 14 is a flowchart of processing in the case where each of the other control units according to the first implementation receives an event recording request.

FIG. 15 is a flowchart of a first example of processing mode setting processing.

FIG. 16 is a flowchart of a second example of the processing mode setting processing.

FIG. 17 is a flowchart of a third example of the processing mode setting processing.

FIG. 18 is a chart illustrating an event data accumulation period of each of the other control units.

FIG. 19 is a flowchart of a processing operation of each of the other control units according to a second implementation.

FIG. 20 is a diagram illustrating a configuration example of an on-board control network.

FIG. 21 is a chart illustrating an event data accumulation period of another control unit in the related art.

DETAILED DESCRIPTION

A detailed description will hereinafter be made on a preferred embodiment of the invention with reference to the accompanying drawings. In the present specification and drawings, components that have substantially the same functional configuration will be denoted by the same reference sign, and an overlapping description thereon will not be made.

1. Detailed Description of Background Art

The background art of the invention will now be described in detail. Thereafter, the embodiments of the invention will be described.

FIG. 20 is a diagram of a configuration example of a control network 10 that mutually connects plural electronic control units (ECU) mounted on a vehicle.

The illustrated control network 10 includes a body system CAN network 20 and a chassis/powertrain system CAN network 30. The body system CAN network 20 and the chassis/powertrain system CAN network 30 are connected in a mutually communicable manner via a gateway ECU 50*h*.

The body system CAN network 20 and the chassis/powertrain system CAN network 30 include plural control units 50*a* to 50*h* (hereinafter collectively referred to as control units 50 unless otherwise distinguished) that are connected in the mutually communicable manner via controller area network (CAN) communication lines.

The body system CAN network 20 includes an airbag ECU 50*a*, a body control ECU 50*b*, a light control ECU 50*c*, and a meter control ECU 50*d* that are connected in the mutually communicable manner via the CAN communication lines.

The airbag ECU 50*a* primarily controls an airbag device by detecting a collision of the vehicle. A passenger seat occupant detection ECU 50*i* is connected to the airbag ECU 50*a* via local Internet network (LIN).

The body control ECU 50*b* primarily controls an air conditioner, power windows, windshield wipers, door locks, and power seats. The light control ECU 50*c* primarily controls lights on the inside and the outside of a vehicle cabin such as a cabin light (a room lamp), headlights, taillights, and side marker lights. The meter control ECU 50*d* primarily detects a vehicle speed of the vehicle to record and display the vehicle speed on a speedometer in a meter panel, and transmits the recorded vehicle speed to other components of the vehicle. In addition, on the basis of a signal indicative of presence or absence of failure that is contained in a message transmitted from any of the control units 50 other than the meter control ECU 50*d* via the CAN communication line, the meter control ECU 50*d* controls a warning lamp that is disposed in the meter panel and indicates abnormality related to any of the control units 50 other than the meter control ECU 50*d*. In the case where the failure is present, the warning lamp for the corresponding control unit 50 is turned on so as to inform a vehicle driver of the failure.

An ECU tester 90 can be connected to the body system CAN network 20 via an on-board diagnosis (OBD) connector 91. For example, the ECU tester 90 transmits a test signal to each of the control units 50 via the CAN communication line and receives a response signal from each of the control units 50 so as to diagnose each of the control units 50.

Alternatively, the ECU tester 90 receives trouble code (diagnostic trouble code) data and failure state record data and provides a reception result on a display. The diagnostic trouble code data is recorded as a result of a failure diagnosis made by each of the control units 50 and indicates a failed part. The failure state record data indicates whether the failure still continues, whether the failure has existed in the past and has been recovered, or the like. Accordingly, for example, the diagnostic trouble code and the failure state are checked after the failed part is identified or the failure is repaired at a dealer or a repair shop. In this way, the ECU tester 90 is used for an operation check of whether the repair is correctly done or the like. After the repair is completed, a mechanic operates the ECU tester 90. Then, the ECU tester 90 transmits a command of deleting the records such as the diagnostic trouble code to the corresponding control unit 50. In the case where the failure is recovered, the corresponding control unit 50 deletes the recorded diagnostic trouble code data, the recorded failure state record data, and the like.

The chassis/powertrain system CAN network 30 includes an automatic transmission ECU 50*e*, a vehicle stability control ECU 50*f*, and an engine ECU 50*g* that are connected in the mutually communicable manner via the CAN communication lines.

The automatic transmission ECU 50*e* primarily controls an automatic transmission. The vehicle stability control ECU 50*f* primarily controls the automatic transmission, a brake system, and an engine in an integrated manner to prevent a sideslip and the like of the vehicle. The engine ECU 50*g* primarily controls the engine.

Each of the control units 50 detects various events that occur to the control unit 50 or the vehicle. Here, the "event" means a phenomenon in which each of the control units 50 is changed from a current state to a different state.

The control unit that has detected the event (hereinafter also referred to as a "host control unit") not only records information of the detected event (hereinafter also referred to as "event data") in the host control unit but also transmits a message containing an event recording request to any of the other control units (hereinafter the control unit that receives a specified message from the host control unit will be referred to as "another control unit") via communication means such as the CAN or the LIN.

Another control unit that has received the message containing the event recording request records an identifier of the host control unit and the event data in another control unit. At this time, another control unit may simultaneously record information of a vehicle state. In this way, an event occurring situation can be acknowledged in detail by analyzing the plural control units 50 that have recorded the event data.

A description will hereinafter be made on a case where the airbag ECU 50*a* that controls the airbag device is the host control unit as an example.

For example, in a vehicle assembly process, a steering wheel is usually assembled at a final stage of a vehicle manufacturing process. After adjustment of a steering neutral position and towing adjustment of front wheels of the vehicle are completed, the steering wheel is assembled to a steering shaft, and a locknut is then fastened. Thereafter, the airbag device used to protect the driver is installed in the steering wheel.

In an energized state, the airbag ECU 50*a* constantly diagnoses whether the airbag device is installed correctly. Thus, in the vehicle assembly process, the airbag ECU 50*a* continues detecting driver seat airbag non-installation failure until the assembly of the steering wheel is completed.

At this time, in the case where other control units 50*b*, 50*c* . . . in the energized states exist, each of other control units 50*b*, 50*c* . . . similarly records failure detection event data in response to the event recording request. In such a case, upon completion of manufacturing of the vehicle, a task of deleting the event data from all of the control units 50, each of which has recorded the event data, is required.

[0033]

During manufacturing of the vehicle, there is a case where an End-Of-Line programming (EOL) operation is executed for each of the control units 50 after the completion of the vehicle assembly, such as after connection of a connector of an electronic control component and fastening of a bolt and a nut to a mechanical component are completed.

The EOL operation is an operation to set presence or absence of functions, an output characteristic, and the like in accordance with a vehicle grade or destination and to make setting for adjustment of individual differences among the vehicles or the components so as to reduce types of the components of the control units 50. The EOL operation is executed after the components are assembled at the final stage of manufacturing of the vehicle. Setting information by the EOL operation is written in non-volatile memory, for example.

More specifically, while each of the control units 50 is configured to be able to correspond to plural vehicle models, installation/non-installation data thereof is stored in the non-volatile memory. The installation/non-installation data corresponds to the vehicle model, on which the control units 50 are mounted. By using the ECU tester 90, which is externally connected in a vehicle manufacturing line, and the like, the installation/non-installation data is input to each of the control units 50 in accordance with a decided vehicle model.

In order to prevent market distribution of the vehicle having the control units 50, for each of which such an EOL operation is not executed, there is a case where each of the control units 50 has a function of diagnosing inexecution of the EOL operation. For example, in the case where the inexecution of the EOL operation is detected by the diagnostic function, each of the control units 50 notifies an assembly worker of abnormality by taking measures to record the failure, turn on the warning lamp, and the like.

In order to make the vehicle available in the market, not only the completion of the assembly but also the completion of the EOL operation for all of the control units 50, each of which requires the EOL operation, is required. Thus, at a vehicle manufacturing stage, each of the control units 50 that are energized prior to the completion of the EOL operation is assembled in a state where the EOL operation is not executed. In the case where each of the control units 50 is brought into an energized state before the EOL operation of each of the control units 50 is appropriately completed, an EOL inexecution event is possibly detected.

Accordingly, each of such control units 50 continuously detects the abnormality until the execution of the EOL operation is completed. In addition, in a situation where the EOL operation is not executed, a control operation is executed at initial setting. Thus, it is considered that failure such as excess installation or non-installation of the equipment is confirmed.

There is also a case where the control units 50 communicate with each other and confirm existence of each other for a diagnosis. For example, in the case where the certain control unit 50 transmits a message at specified intervals and another control unit 50 receives the message, it is determined whether the message as a reception target is disrupted for a longer period than the transmission interval, for example. In this way, the disruption of the reception target message is diagnosed.

Furthermore, contents of the message that is transmitted and received by each of the control units 50 belonging to the body system CAN network 20, the chassis/powertrain system CAN network 30, or the like and a routing rule of the message that is processed by the gateway ECU 50*h* via those networks are possibly changed before and after the EOL operation. Thus, there is a case where the periodical transmission and reception of the message, which is used to confirm the existence of each other, cannot be conducted in a normal way.

For example, there is a case where processing to confirm the existence of each other cannot be executed in a normal way due to a difference in a power supply mode, a difference in a communication mode, presence or absence of the equipment resulted from a difference in the vehicle grade, or the like. More specifically, the certain control unit 50 is possibly configured that transmission of a message "A" is invalid in an initial state and then a periodical transmission function of the specified message is set from invalid to valid by the EOL operation. Also in such a state, it is considered that the failure of the control unit 50 is confirmed.

For example, during manufacturing of the vehicle or during repair maintenance work of the vehicle, in the case where each of the control units 50 is brought into the energized state before each of the control units 50 is connected to the CAN communication line 15, a CAN communication disruption event is possibly detected.

In the case where the control unit 50 that has detected the event exists in the above-exemplified situations, another control unit 50 also has to record the event data in response to the event recording request from the corresponding control unit 50 to another control unit 50.

The function of recording the event data by each of the control units 50 is originally intended to record the event data that is detected during use of the vehicle after delivery thereof to the market. Regardless of this fact, the unintended event data is recorded.

When the control unit 50 that has detected any of these unintended events transmits the message containing the event recording request to another control unit 50, another control unit 50 records the event data therein.

Recording of the unintended event data at the vehicle manufacturing stage described above is anticipated but is conducted. Thus, it is necessary to delete the recorded event data before the delivery of the vehicle to the market.

Recording of the unintended event data, just as described, is conducted not only at the vehicle manufacturing stage but also during the repair maintenance work of the vehicle after the delivery of the vehicle from an assembly plant. When the failure of the vehicle is repaired at the repair shop, repair work is performed under environment where the failure detection as described above is anticipated. Thus, after maintenance of the vehicle is completed, it is necessary to delete the recorded event data.

For example, in the case where any of the control units 50, which are the targets of the EOL operation, is replaced during the repair maintenance work of the vehicle after the delivery of the vehicle from the vehicle assembly plant, the control unit 50 in the initial state is possibly assembled to the vehicle, and the EOL operation is executed therefor after the assembly. Thus, similar to the vehicle manufacturing stage, it is anticipated that the failure is confirmed.

FIG. 21 is a chart illustrating an event data accumulation period in the case where the conventional control units are used. As described above, at the vehicle manufacturing stage, the control unit that has detected the event records the event data and transmits the message containing the event recording request to another control unit.

In conjunction with this, another control unit records the unintended event data, and the event data is accumulated in the non-volatile memory of each of the control units. Recording of the unintended event data is inevitable at the vehicle manufacturing stage. Thus, the task of deleting the accumulated unintended event data is performed when manufacturing of the vehicle is completed and the vehicle is delivered to the market.

Similarly, during maintenance or repair work of the vehicle, the task of deleting the accumulated unintended event data is performed upon the completion of the work. Time required for the task of deleting the event data is increased as the number of the control units on the network is increased. Along with this, work hours in the vehicle manufacturing process or the vehicle repair process are increased, and consequently, manufacturing cost or repair cost is increased.

Against this background, the control system for the vehicle according to this embodiment can reduce workload of deleting the unintended event data that is anticipated in advance.

2. Basic Configuration Example of Control System for Vehicle

First, a description will be made on a basic configuration example of the control system for the vehicle that is shared by implementations, which will be described below.

2-1. Overall Configuration Example of Control System for Vehicle

FIG. 1 is a schematic view illustrating an overall configuration example of a control system 40 for a vehicle according to this embodiment in a simplified manner. FIG. 1 illustrates a part of the control system for the vehicle in FIG. 20 in the simplified manner. The control system 40 includes the plural control units 50. Hereinafter, a description will be made on an example of a case where the airbag ECU 50*a* functions as the host control unit and the body control ECU 50*b*, the light control ECU 50*c*, and the meter control ECU 50*d* function as other control units.

In the description of this embodiment, when the airbag ECU 50*a*, the body control ECU 50*b*, the light control ECU 50*c*, and the meter control ECU 50*d* as the plural control units do not have to be distinguished from each other, they will collectively and simply be referred to as the control units 50.

The control units 50 control devices 70*a*, 70*b*, 70*c*, 70*d* that are connected thereto. Each of the control units 50 exchanges the message with each other via a CAN communication line 15.

The passenger seat occupant detection ECU 50*i* is connected to the airbag ECU 50*a* in the mutually communicable manner via a LIN communication line 17.

2-2. Functional Configuration of Control Unit

FIG. 2 is a block diagram of a functional configuration of the control unit 50 that can be applied to the control system 40 for the vehicle according to this embodiment. The illustrated configuration example of the control unit 50 can be applied to both of the host control unit that detects the event occurred to itself and each of other control units that receive the message containing the event recording request.

The control unit 50 is configured by including a processor such as a CPU. The control unit 50 includes a mode setting section 51, a diagnosis section 52, an event information acquisition section 53, an event processing section 55, a storage section 57, and a communication section 59. Of these, the mode setting section 51, the diagnosis section 52, the event information acquisition section 53, and the event processing section 55 have functions that are realized when the processor such as the CPU executes various programs.

Instead of being constructed of the processor such as the CPU or an MCU, the control unit 50 may partially or entirely be constructed of a member in which firmware and the like can be updated, or may be a program module or the like that is executed by a command from the CPU or the like.

The communication section 59 is an interface that transmits the message to the CAN communication line 15 and receives the message from the CAN communication line 15.

The storage section 57 includes non-volatile memory that at least stores the acquired event data. The storage section 57 also includes memory elements such as read-only memory (ROM) and random-access memory (RAM). The ROM stores a software program, a control parameter, and the like, and the RAM stores acquired information, the control parameter, and information such as an arithmetic processing result. In addition to the above, the storage section 57 may include a memory device that has another memory medium such as a CD-ROM or a storage device.

The mode setting section 51 controls processing modes of the control unit 50. A market mode as one of the processing modes is a processing mode that is set after the vehicle is manufactured and delivered to the market and in a state other than the repair maintenance of the vehicle. That is, the market mode is the processing mode that is set when the vehicle is in a normal use state after the completion of the vehicle.

The mode setting section 51 sets the processing mode of the control unit 50 to the market mode when the worker inputs an operation to the ECU tester 90 (see FIG. 20), which is connected thereto via the CAN communication line 15, or in accordance with contents of the detected event or contents of the received message, for example.

The mode setting section 51 once sets the processing mode of the control unit 50 to the market mode. Thereafter, when the vehicle is delivered and becomes available in the market and the repair maintenance work thereof is initiated at the dealer, the repair shop, or the like, for example, the mode setting section 51 resets the processing mode from the market mode. The processing mode is reset when the worker inputs the operation to the ECU tester 90, which is connected to the control unit 50 via the CAN communication line 15, for example.

In addition to the market mode, examples of the processing mode that can be set by the mode setting section 51 include a plant mode, a dealer mode, and a supplier mode that are set at the vehicle manufacturing stage or a repair maintenance stage.

The diagnosis section 52 diagnoses the control unit 50 of itself, a corresponding device 70 connected to the control unit 50 of itself, or components on a subnetwork connected by the LIN communication line 17. For example, the diagnosis section 52 may make a CAN disruption diagnosis to diagnose the communication disruption via the CAN communication line 15, a failure diagnosis of a sensor connected to the control unit 50, or the like. The diagnosis section 52 stores information on a diagnosis result in the storage section 57.

The event information acquisition section 53 acquires various types of the event data that occur to the control unit 50 or the vehicle. For example, when the control unit 50 detects the event by itself, an operation to detect the event corresponds to processing to acquire the event data. For example, the event information acquisition section 53 in the control unit 50 detects the event on the basis of a result of diagnostic processing that is executed by the diagnosis section 52.

In the case where another control unit 50 detects the event and the control unit 50 receives the message containing the event recording request that is transmitted from another control unit 50, an operation to receive the recording request corresponds to the processing to acquire the event data.

The events detected by the event information acquisition section 53 in the control unit 50 include the following events, for example.

Communication disruption event
Abnormality detection event
Abnormality recovery event
Failure confirmation event
Failure recovery event
EOL inexecution event
Manufacturing malfunction event The communication disruption event is an event that is detected when the communication with the CAN communication line 15 or the LIN communication line 17 is disrupted. For example, when a communication line that connects the control unit 50 and the CAN communication line 15 is disconnected, the control unit 50 cannot receive a CAN message as a reception target. In such a case, the communication disruption event is detected.

Alternatively, in the case where the EOL operation is not executed for another control unit 50 that is supposed to transmit the CAN message as the reception target of the control unit 50 and thus the CAN message is not transmitted by the periodical transmission function, the control unit 50 cannot receive the CAN message. Thus, the communication disruption event is detected.

The abnormality detection event is an event that is detected when abnormality related to the control unit 50 is found. For example, the event information acquisition section 53 detects the abnormality detection event when the abnormality is found by the failure diagnosis of the device 70*a* that is connected to the control unit 50. The abnormality recovery event is an event that is detected when the abnormality related to the control unit 50 is recovered.

The failure confirmation event is an event that is detected when the abnormality related to the control unit 50 is confirmed. For example, in the case where a state where the abnormality of the device 70 connected to the control unit 50 is detected continues for a specified period, the event information acquisition section 53 confirms failure and sets such an event as the failure confirmation event. In addition, in the case where a state where the abnormality related to the control unit 50 is recovered continues for a specified period, the event information acquisition section 53 confirms recovery of the failure and sets such an event as the failure recovery event.

The example in which the abnormality detection event, the abnormality recovery event, the failure confirmation event, and the failure recovery event are applied to the device 70 that is connected to the control unit 50 has been described. However, the abnormality detection event, the abnormality recovery event, the failure confirmation event, and the failure recovery event may be applied to a circuit that is installed in the control unit 50.

The EOL inexecution event is an event that is detected when the EOL operation is not executed for the control unit 50. For example, in the case where the EOL operation is not executed or the setting information that is written in the non-volatile memory of the storage section 57 by the EOL operation is abnormal, the event information acquisition section 53 detects the EOL inexecution event on the basis of the diagnostic processing to diagnose inexecution of the EOL operation.

The manufacturing malfunction event is an event in which the detection thereof is valid only during manufacturing of the vehicle or during the repair maintenance work, during which the processing mode other than the market mode is set. As the manufacturing malfunction event, the failure confirmation event is exemplified. An example of the failure confirmation event is fitting failure between a connector pin and a connector of the control unit 50 or a connector of an unillustrated wire harness that mutually connects the devices 70 during manufacturing of the vehicle. In addition, another example of the manufacturing malfunction event is the failure confirmation event that occurs due to disconnection of the wire harness that connects the control unit 50 and the device 70. Further another example of the manufacturing malfunction event is the failure confirmation event due to CAN message communication disruption that disallows the reception of the CAN message transmitted from the control unit 50. Moreover, yet another example of the manufacturing malfunction event is the failure confirmation event that occurs due to continuity of EOL inexecution failure when the EOL operation is not correctly executed.

It is often the case that the manufacturing process and manufacturing facilities at a vehicle manufacturing plant are shared among manufacturing of plural vehicle models. Accordingly, prototype vehicles of a new model and currently mass-produced vehicles are manufactured on the same vehicle manufacturing line in a time period near mass production of the new model. The prototype vehicles of the new model are manufactured in limited number to check the manufacturing process and the manufacturing facilities as a primary purpose. The currently mass-produced vehicles are manufactured on the existing vehicle manufacturing line. In the cases where a diagnostic trouble code that indicates disconnection failure of the wire harness of the device or a diagnostic trouble code that indicates the CAN message communication disruption is recorded and a vehicle storing such a record is found in the manufacturing process of the prototype vehicle, an instrument is used to investigate a cause of the failure in the manufacturing process. This temporarily stops the manufacturing line of the already mass-produced vehicles. As a result, a manufacturing efficiency of the entire plant is degraded. Thus, it is often difficult to conduct such an investigation.

For the above reason, when the manufacturing malfunction event is detected, the message containing the event recording request is transmitted to other control units 50, and the information of such an event is recorded not only in the host control unit 50 but also in other control units 50. In this way, it is possible to identify which time point the failure has occurred, and this is advantageous to the identification of the abnormal portion and the recovery of the failure.

The plant mode may only be set during manufacturing of the prototype vehicles, for which a mass-production process and mass-production facilities are used. In addition, the plant mode may be canceled when the mass-production of the new model is initiated and it is confirmed that the new model can stably be manufactured. The plant mode may be set in advance at a part supplier that manufactures the control units 50, and the control units 50 may then be delivered to the vehicle manufacturing plant. In this case, the plant mode is already set when an ignition switch of the vehicle is turned ON from OFF. Thus, an effect of preventing recording of the unnecessary events can be exerted. In addition, the plant mode may be switched to the market mode in an EOL process during the vehicle manufacturing process.

Some of the functions of the vehicle that are usually used in the market are unnecessary in the manufacturing process or an inspection process at the dealer. In the processing modes other than the market mode, information on abnormality or failure of each of these functions does not have to be recorded in the other control units 50. Thus, it is advantageous to selectively switch necessity/unnecessity of recording in the other control unit 50 depending on whether the processing mode of the control unit 50 is the market mode or the mode other than the market mode.

The event information acquisition section 53 in the control unit 50 that has detected the event transmits the message containing the event recording request onto the CAN communication line 15 via the communication section 59. In this way, the event information acquisition section 53 in each of the other control unit 50 that have received the message via the communication section 59 acquires the event recording request.

The event processing section 55 executes processing to record the acquired event data in the non-volatile memory. As a basic function of the event processing section 55, the event processing section 55 in the control unit 50 that has detected a specified event executes the processing to record the event data in the non-volatile memory of the storage section 57 in the control unit 50.

In addition, the event processing section 55 in the control unit 50 that has detected the event executes processing to transmit the identifier of the control unit 50 and the message containing the event recording request onto the CAN communication line 15 depending on whether the processing mode of the control unit 50 is set to the market mode.

When each of other control units 50 receives the message containing the event recording request, the event processing section 55 in each of other control units 50 executes processing to record the event data and the identifier of the control unit 50, which has transmitted the message, in the non-volatile memory of the storage section 57 in each of other control units 50.

At this time, depending on whether the processing mode of each of other control units 50 is set to the market mode, the event processing section 55 in each of other control units 50 records or does not record the event data in the non-volatile memory of the storage section 57 in each of other control units 50.

In the case where the processing mode of each of other control units 50 is set to the market mode, the event processing section 55 in each of other control units 50 executes the processing to record the event data in the non-volatile memory of the storage section 57 in each of other control units 50.

On the other hand, in the case where the processing mode of each of other control units 50 is not set to the market mode, the event processing section 55 in each of other control units 50 executes processing to prevent partial or complete recording of the event data in the non-volatile memory of the storage section 57. In this way, after the completion of manufacturing of the vehicle or the repair maintenance work of the vehicle, the workload of deleting the unintended event data records can be reduced.

2-3. Specific Configuration Example of Airbag Control System

Next, a specific description will be made on a configuration example of an airbag control system 1000 as one example of the control system 40 for the vehicle according to this embodiment.

FIG. 3 is a diagram illustrating the configuration example of the airbag control system 1000 that includes the airbag ECU 50*a*. The airbag control system 1000 monitors a sensor signal that is detected by each of various acceleration sensors provided in the vehicle and deploys airbags in portions such as the driver seat and the passenger seat when determining that the collision of the vehicle has occurred. In this way, safety of the occupant(s) during the collision of the vehicle is improved.

The airbag control system 1000 includes the airbag ECU 50*a*, the passenger seat occupant detection ECU 50*i*, the meter control ECU 50*d*, a battery power supply 400, and an ignition switch 410. The airbag ECU 50*a*, the meter control ECU 50*d*, and the passenger seat occupant detection ECU 50*i* respectively correspond to the control unit 50*a*, the control unit 50*d*, and the control unit 50*i* of the control system 40 illustrated in FIG. 1. Although not illustrated in FIG. 3, the body control ECU 50*b*, the light control ECU 50*c*, and the like are connected to CAN communication lines 15L, 15H in the mutually communicable manner.

The airbag control system 1000 also includes a driver-seat-side airbag squib 500, a passenger-seat-side airbag squib 510, a right-side airbag squib 520, a left-side airbag squib 530, a right curtain airbag squib 540, and a left curtain airbag squib 550.

The airbag control system 1000 further includes a front-right acceleration sensor 600, a front-left acceleration sensor 610, a right-side acceleration sensor 620, and a left-side acceleration sensor 630.

The battery power supply 400 is any of various storage batteries such as a lead storage battery that is mounted on the vehicle. The battery power supply 400 directly supplies power to the meter control ECU 50*d* and the light control ECU 50*c* via a power supply line 405 and also directly supplies the power to the various control units, which are not illustrated, in the vehicle via the power supply line 405.

The ignition switch 410 is a switch used to start or stop the engine of the vehicle. In a state where the engine of the vehicle is stopped, the ignition switch 410 is "OFF". When a user turns a key in this state, the ignition switch 410 is turned "ON".

When the ignition switch 410 is turned "ON", the battery power supply 400 supplies the power to the meter control ECU 50*d*, the passenger seat occupant detection ECU 50*i*, and the airbag ECU 50*a* via an ignition line 407.

The meter control ECU 50*d* transmits a turn-on signal, a display signal, or the like to a warning lamp 201 and an unillustrated instrument panel. For example, the meter control ECU 50*d* executes turn-on/turn-off control of an airbag warning lamp on the meter panel on the basis of an airbag warning lamp ON/OFF signal that is transmitted from the airbag ECU 50*a*. In addition, the meter control ECU 50*d* executes turn-on/turn-off control of lighting on the meter panel itself on the basis of a headlight turn-on/turn-off signal that is transmitted from the light control ECU 50*c*. The meter control ECU 50*d* detects and records the vehicle speed on the basis of a signal of a vehicle speed sensor and transmits the recorded vehicle speed to the airbag ECU 50*a* via the CAN communication lines 15L, 15H. Similarly, the unillustrated vehicle stability control ECU detects and records a brake operation state of the driver on the basis of a signal of an unillustrated brake switch and transmits the recorded brake operation state to the airbag ECU 50*a* via the CAN communication lines 15L, 15H.

In this way, the airbag ECU 50*a* can detect in what state the vehicle is operated, for example, a braking state and the like of the vehicle. In addition to the above, the airbag ECU 50*a* detects information of various states of the vehicle via the body control ECU 50*b*, the light control ECU 50*c*, and the meter control ECU 50*d*.

The passenger seat occupant detection ECU 50*i* detects weight on a seat in the passenger seat of the vehicle on the basis of a signal of an unillustrated load sensor and determines an occupant state of the passenger seat. For example, the passenger seat occupant detection ECU 50*i* determines states of presence of an adult male, a petite female, or a child and an empty seat.

The passenger seat occupant detection ECU 50*i* transmits the determined occupant state of the passenger seat to the airbag ECU 50*a* via the LIN communication line 17. The airbag ECU 50*a* monitors the occupant state on the passenger seat, for example. In this way, for example, in the case where the occupant of the passenger seat is the child during a frontal collision of the vehicle, the airbag ECU 50*a* inhibits unexpected energization of the passenger-seat-side airbag squib 510 and thus can prevent deployment of an unillustrated passenger seat side airbag.

The airbag ECU 50*a* includes a voltage detector 101, a booster circuit 102, a voltage detector 103, a capacitor (a backup power supply) 104, voltage detection interfaces (I/F) 105, 107, a DC-DC converter 106, a CAN communication transceiver 108, and a LIN communication transceiver 110.

The airbag ECU 50*a* also includes a micro-controller unit (MCU) 120, an application specific integrated circuit (ASIC) 140, an acceleration sensor 150, and a non-volatile memory 160.

The voltage detector 101 detects a value of a power supply voltage that is supplied from the battery power supply 400 to the airbag ECU 50*a* via the ignition switch 410. The voltage detection I/F 105 is an interface that outputs a signal of the voltage detected by the voltage detector 101 to the MCU 120. The signal of the voltage that is detected by the voltage detector 101 is output to the MCU 120 via the voltage detection I/F 105.

The booster circuit 102 is a circuit that boosts the power supply voltage supplied from the battery power supply 400 to the airbag ECU 50*a* via the ignition switch 410. For example, the booster circuit 102 boosts the power supply voltage at 9 V to 16 V that is supplied from the battery power supply 400 to approximately 33 V. The booster circuit 102 supplies the boosted voltage to the capacitor 104 and the DC-DC converter 106.

The voltage detector 103 detects a value of the power supply voltage that is output from the booster circuit 102. The voltage detection I/F 107 is an interface that outputs a signal of the voltage detected by the voltage detector 103 to the MCU 120. The signal of the voltage that is detected by the voltage detector 103 is output to the MCU 120 via the voltage detection I/F 107.

The capacitor 104 is a capacitor that charges/discharges the voltage supplied from the booster circuit 102 and serves as the backup power supply of the battery power supply 400. The DC-DC converter 106 is a converter that converts (lowers) the voltage supplied from the booster circuit 102 to a voltage (for example, 5 V) to be used in the MCU 120. The DC-DC converter 106 supplies the lowered voltage to the MCU 120.

The CAN communication transceiver 108 is an interface that exchanges the message among the meter control ECU 50*d*, the unillustrated body control ECU 50*b*, and the unillustrated light control ECU 50*c* via the CAN communication lines 15L, 15H on the basis of a CAN standard. The data received by the CAN communication transceiver 108 is transmitted to the MCU 120.

The LIN communication transceiver 110 is an interface that transmits/receives the data to/from the passenger seat occupant detection ECU 50*i* via the LIN communication line 17. The LIN communication transceiver 110 converts a voltage level of a communication signal. For example, the LIN communication transceiver 110 converts a 5-V signal level that can be handled by the MCU 120 to a voltage level (12 V) for the LIN.

The MCU 120 includes an analog-to-digital converter (A/D) 121, a CPU 122, a ROM 124, a RAM 126, and a CAN communication controller 128. The MCU 120 also includes a LIN communication controller 132 and serial peripheral interfaces (SPIs) 134, 136, 138. The ROM 124, the RAM 126, and the non-volatile memory 160 correspond to the storage section 57 illustrated in FIG. 2.

The A/D 121, the CPU 122, the ROM 124, the RAM 126, the CAN communication controller 128, the LIN communication controller 132, and the SPIs 134, 136, 138 are connected to each other via an internal bus 170 of the MCU 120.

The A/D 121 converts an analog voltage signal that is input via the voltage detection I/Fs 105, 107 to a digital voltage signal. The CPU 122 is an arithmetic processing section that executes various programs stored in the ROM 124 or the RAM 126. The CPU 122 carries out various functions of the airbag ECU 50*a* by executing the various programs stored in the ROM 124 or the RAM 126.

In the example of the airbag ECU 50*a* illustrated in FIG. 3, when the CPU 122 executes the various programs, the functions of the mode setting section 51, the diagnosis section 52, the event information acquisition section 53, and the event processing section 55 illustrated in FIG. 2 are realized.

The ROM 124 is memory that stores the data and the various programs to carry out the various functions of the airbag ECU 50*a*. The RAM 126 is memory that has relatively small capacity, enables high-speed access, and stores an arithmetic result of each of the programs executed by the CPU 122 among the various programs stored in the ROM 124.

The CAN communication controller 128 is a controller that communicates with the meter control ECU 50*d* or other unillustrated components of the vehicle via the CAN communication transceiver 108. The LIN communication controller 132 controls asynchronous serial communication.

The airbag ECU 50*a* communicates with the passenger seat occupant detection ECU 50*i* via the LIN communication transceiver 110.

In the example of the airbag ECU 50*a* illustrated in FIG. 3, the MCU 120 transmits/receives the data via the CAN communication transceiver 108 and the LIN communication transceiver 110 and uses the data to carry out the functions of the communication section 59 illustrated in FIG. 2.

The SPI 134 is an interface for clock synchronous serial communication and is an interface between the ASIC 140 and each of the devices in the MCU 120. The SPI 136 is an interface between the acceleration sensor 150 and each of the devices in the MCU 120. The SPI 138 is an interface between the non-volatile memory 160 and each of the devices in the MCU 120.

The acceleration sensor 150 is a sensor that detects acceleration at a position where the airbag ECU 50*a* is disposed. The acceleration sensor 150 outputs the detected acceleration to the MCU 120 via the SPI 136. For example, the airbag ECU 50*a* is usually provided on a center shaft in a vehicle longitudinal direction. More specifically, the airbag ECU 50*a* is fixed to a high rigid portion on a floor tunnel of a vehicle body by mechanical fastening means such as a combination of a bolt and a nut or a combination of a bolt and a tapped hole. In a collision phenomenon in which a front surface or a side surface of the vehicle body receives an impact, the acceleration sensor 150 that is installed in the airbag ECU 50*a* detects the acceleration via the vehicle body.

The non-volatile memory 160 is memory that keeps the records even when the power is not supplied thereto, and is electrically erasable programmable read-only memory (EEPROM). The non-volatile memory 160 records the data that is output from the MCU 120 via the SPI 138, for example.

The ASIC 140 is an integrated circuit in which circuits with plural functions are integrated. The ASIC 140 includes a squib I/F 142 and a sensor I/F 144. The squib I/F 142 is an interface that transmits an airbag deployment signal to each of the driver-seat-side airbag squib 500, the passenger-seat-side airbag squib 510, the right-side airbag squib 520, the left-side airbag squib 530, the right curtain airbag squib 540, and the left curtain airbag squib 550.

The sensor I/F 144 is an interface that receives acceleration signals transmitted from the front-right acceleration sensor 600, the front-left acceleration sensor 610, the right-side acceleration sensor 620, and the left-side acceleration sensor 630. Each of the front-right acceleration sensor 600 and the front-left acceleration sensor 610 is mechanically fastened to a high rigid metal portion in a front portion of the vehicle body and detects the acceleration that is generated during the collision against the front portion of the vehicle body. Each of the right-side acceleration sensor 620 and the left-side acceleration sensor 630 is fastened to a substantially side surface portion of the vehicle body on the inside of the vehicle cabin, such as a portion near a base of a B pillar that is located on the side surface of the vehicle body. Each of the right-side acceleration sensor 620 and the left-side acceleration sensor 630 detects the impact in a lateral direction of the vehicle body that is received during a side surface collision of the vehicle body. The airbag ECU 50*a* is connected to each of the front-right acceleration sensor 600, the front-left acceleration sensor 610, the right-side acceleration sensor 620, and the left-side acceleration sensor 630 by electric attachment/detachment means such as a connector via a wire harness.

The driver-seat-side airbag squib 500 supplies a current to an igniter (a squib) on the driver seat side, ignites a gas-forming agent, and generates high-pressure gas on the basis of the deployment signal that is transmitted from the MCU 120 via the squib I/F 142. In this way, the driver-seat-side airbag squib 500 inflates the airbag instantaneously.

Similarly, each of the passenger-seat-side airbag squib 510, the right-side airbag squib 520, the left-side airbag squib 530, the right curtain airbag squib 540, and the left curtain airbag squib 550 inflates corresponding one of the airbags that are disposed in various portions of the vehicle on the basis of the deployment signal transmitted from the MCU 120.

The front-right acceleration sensor 600 is an acceleration sensor that is disposed on a right side in the front portion of the vehicle, and transmits the detected acceleration to the MCU 120 via the sensor I/F 144. Similarly, the front-left acceleration sensor 610, the right-side acceleration sensor 620, and the left-side acceleration sensor 630 are disposed in the various portions of the vehicle. Each of the front-left acceleration sensor 610, the right-side acceleration sensor 620, and the left-side acceleration sensor 630 detects the acceleration in the corresponding portion of the vehicle and transmits the detected acceleration to the MCU 120.

2-4. Events Detected by Airbag ECU

In the case where the control unit is the airbag ECU 50*a*, the event information acquisition section 53 illustrated in FIG. 2 detects events that are unique to the airbag ECU 50*a* in addition to the common events detected by the control units 50 described above. For example, in addition to the above-described common events, the events detected by the event information acquisition section 53 in the airbag ECU 50*a* may include the following events.

Collision phenomenon detection event
Airbag deployment event
Collision processing completion event
Collision recording initiation event
Collision recording completion event The collision phenomenon detection event as the unique event is an event that is detected, for example, when the airbag ECU 50*a* detects the impact that is detected on the basis of the sensor signal of any of the acceleration sensors 150, 600, 610, 620, 630 and the impact exceeds specified impact intensity.

The airbag deployment event is an event that is detected, for example, when the airbag ECU 50*a* drives any of the airbag squibs 500, 510, 520, 530, 540, 550 to deploy the airbag.

The collision processing completion event is an event that is detected, for example, when the airbag ECU 50*a* completes specified processing such as the deployment of the airbag after occurrence of the collision of the vehicle.

The collision recording initiation event is an event that is detected, for example, when the airbag ECU 50*a* initiates recording of the collision upon the detection of the specified impact intensity.

The collision recording completion event is an event that is detected, for example, when the above-described collision recording is completed.

The event information acquisition section 53 possibly detects any of these unique events also during manufacturing of the vehicle or during the repair maintenance work of the vehicle. For example, the event information acquisition section 53 possibly detects the collision phenomenon detection event when the acceleration sensor receives the strong impact.

For example, also during manufacturing of the vehicle or during the repair maintenance work of the vehicle, in the case where the airbag ECU 50*a* is brought into the energized state before the airbag squibs or the acceleration sensors are connected to the airbag ECU 50*a*, the event information acquisition section 53 in the airbag ECU 50*a* detects the abnormality detection event.

For example, also during manufacturing of the vehicle or during the repair maintenance work of the vehicle, in the case where the airbag squibs or the acceleration sensors are connected to the airbag ECU 50*a* before a specified period elapses from the detection of the abnormality detection event, the event information acquisition section 53 in the airbag ECU 50*a* detects the abnormality recovery event.

For example, also during manufacturing of the vehicle or during the repair maintenance work of the vehicle, in the case where the detection of the abnormality detection event continues for the specified period, the event information acquisition section 53 in the airbag ECU 50*a* detects the failure confirmation event.

For example, also during manufacturing of the vehicle or during the repair maintenance work of the vehicle, in the case where the airbag squibs or the acceleration sensors are connected to the airbag ECU 50*a* after the detection of the failure confirmation event, the event information acquisition section 53 in the airbag ECU 50*a* detects the failure recovery event.

2-5. Transmission Setting of Event Recording Request by Host Control Unit

FIG. 4 is a table illustrating a setting example of necessity/unnecessity of transmitting the message containing the event recording request by the airbag ECU 50*a* as the host control unit that detects a specified event.

Setting of necessity/unnecessity of transmitting the message containing the event recording request from the airbag ECU 50*a* to each of the body control ECU 50*b*, the light control ECU 50*c*, and the meter control ECU 50*d* differs between a case where the processing mode of the airbag ECU 50*a* is set to the market mode and a case where the processing mode of the airbag ECU 50*a* is set to any of the processing modes other than the market mode.

In the case where the processing mode of the airbag ECU 50*a* is set to the market mode, the airbag ECU 50*a* transmits the message containing the event recording request to each of the body control ECU 50*b*, the light control ECU 50*c*, and the meter control ECU 50*d* in regard to all the events other than the manufacturing malfunction event.

In the case where the processing mode of the airbag ECU 50*a* is set to the market mode, the airbag ECU 50*a* does not transmit the message containing the event recording request for the manufacturing malfunction event to each of the body control ECU 50*b*, the light control ECU 50*c*, and the meter control ECU 50*d*.

Meanwhile, in the case where the processing mode of the airbag ECU 50*a* is set to any of the processing modes other than the market mode, the airbag ECU 50*a* transmits the message containing the event recording request for the manufacturing malfunction event, for example, to each of the body control ECU 50*b*, the light control ECU 50*c*, and the meter control ECU 50*d*.

In the case where the processing mode of the airbag ECU 50*a* is set to any of the processing modes other than the market mode, the airbag ECU 50*a* does not transmit the message for any of the events other than the manufacturing malfunction event, for example, to each of the body control ECU 50*b*, the light control ECU 50*c*, and the meter control ECU 50*d*.

Note that the setting example illustrated in FIG. 4 is merely one example, and setting can appropriately be changed in accordance with a type of the event or a purpose.

2-6. Setting of Necessity/Unnecessity of Event Recording by Other Control Units FIG. 5 is a table illustrating a setting example of necessity/unnecessity of recording the event data by each of the body control ECU 50*b*, the light control ECU 50*c*, and the meter control ECU 50*d* that have received the message containing the event recording request from the airbag ECU 50*a*.

Setting of necessity/unnecessity of event recording by each of the body control ECU 50*b*, the light control ECU 50*c*, and the meter control ECU 50*d* in the non-volatile memory 160 differs between a case where the processing mode of each of the body control ECU 50*b*, the light control ECU 50*c*, and the meter control ECU 50*d* is set to the market mode and a case where the processing mode of each of the body control ECU 50*b*, the light control ECU 50*c*, and the meter control ECU 50*d* is set to any of the processing modes other than the market mode.

In the case where the processing mode of each of the body control ECU 50*b*, the light control ECU 50*c*, and the meter control ECU 50*d* that have received the message containing the event recording request is set to the market mode, each of the body control ECU 50*b*, the light control ECU 50*c*, and the meter control ECU 50*d* records the event data in the non-volatile memory 160 in accordance with the recording request message for any of the events other than the manufacturing malfunction event.

In the case where the processing mode of each of the body control ECU 50*b*, the light control ECU 50*c*, and the meter control ECU 50*d* that have received the message containing the event recording request is set to the market mode, each of the body control ECU 50*b*, the light control ECU 50*c*, and the meter control ECU 50*d* does not record the event data of the manufacturing malfunction event in the non-volatile memory 160.

Meanwhile, in the case where the processing mode of each of the body control ECU 50*b*, the light control ECU 50*c*, and the meter control ECU 50*d* is set to any of the processing modes other than the market mode, each of the body control ECU 50*b*, the light control ECU 50*c*, and the meter control ECU 50*d* records the event data in a non-volatile memory of corresponding one of the body control ECU 50*b*, the light control ECU 50*c*, and the meter control ECU 50*d* in accordance with the recording request message for the manufacturing malfunction event, for example.

In the case where the processing mode of each of the body control ECU 50*b*, the light control ECU 50*c*, and the meter control ECU 50*d* is set to any of the processing modes other than the market mode, each of the body control ECU 50*b*, the light control ECU 50*c*, and the meter control ECU 50*d* does not record the event data of any of the events other than the manufacturing malfunction event, for example, in the non-volatile memory of corresponding one of the body control ECU 50*b*, the light control ECU 50*c*, and the meter control ECU 50*d*.

Note that the setting example illustrated in FIG. 5 is merely one example, and setting can appropriately be changed in accordance with the type of the event or the purpose.

The description has been made so far on the control system 40 for the vehicle according to this embodiment and the configuration example of the airbag control system 1000 as the specific example thereof. Various types of the processing executed by the control units 50 that are connected to each other in the mutually communicable manner will hereinafter be described in detail by adopting the airbag control system 1000 as an example.

3. First Implementation

In the airbag control system 1000 according to a first implementation, the airbag ECU 50*a* that has detected the event switches necessity/unnecessity of transmitting the message containing the event recording request to each of the body control ECU 50*b*, the light control ECU 50*c*, and the meter control ECU 50*d* in accordance with the processing mode.

3-1. Operation Example of Airbag ECU

FIG. 6 is a flowchart that schematically illustrates a series of processing operations executed by the airbag ECU 50*a* as the host control unit.

(Initial Diagnostic processing)

First, when the airbag ECU 50*a* is initialized (step S101), the diagnosis section 52 in the airbag ECU 50*a* executes initial diagnostic processing (step S103).

FIG. 7 is a flowchart of one example of the initial diagnostic processing of an external sensor that is connected to the airbag ECU 50*a* as one example of the initial diagnosis. The external sensor is any of the front-right acceleration sensor 600, the front-left acceleration sensor 610, the right-side acceleration sensor 620, and the left-side acceleration sensor 630 illustrated in FIG. 3, for example.

First, the diagnosis section 52 receives ID data that identifies a model of the external sensor (step S111). Next, the diagnosis section 52 determines whether the received ID matches a specified value (step S113). The specified value is a value that is stored in the storage section 57 in advance as the ID corresponding to the external sensor to be used.

If the received ID matches the specified value (S113/Yes), the failure is not detected by the initial diagnosis. Thus, the diagnosis section 52 terminates the initial diagnostic processing. On the other hand, if the received ID does not match the specified value (S113/No), the diagnosis section 52 executes processing to record a diagnostic trouble code (DTC) that corresponds to ID mismatch failure of the external sensor in the storage section 57 (step S115).

Next, the diagnosis section 52 issues the event recording request for the ID mismatch failure of the external sensor (step S117). The event recording request is instruction data that makes the event processing section 55 record the event of the ID mismatch failure in the non-volatile memory 160 of the airbag ECU 50*a* itself.

Next, the diagnosis section 52 issues an event notification request for the ID mismatch failure of the external sensor (step S119). The event notification request is command information that makes the event processing section 55 transmit the message containing the event recording request to each of the body control ECU 50*b*, the light control ECU 50*c*, and the meter control ECU 50*d*.

After issuing the event recording request and the event notification request for the ID mismatch failure, the diagnosis section 52 terminates the initial diagnostic processing.

(Diagnostic processing During Normal Time)

Returning to FIG. 6, after the termination of the initial diagnostic processing (S103), the diagnosis section 52 in the airbag ECU 50*a* executes diagnostic processing during normal time (step S105). The diagnosis during the normal time includes a communication disruption diagnosis or an external sensor failure diagnosis, for example.

FIG. 8 is a flowchart of one example of external sensor failure diagnostic processing as one example of the diagnosis during the normal time. First, the diagnosis section 52 in the airbag ECU 50*a* acquires detection data from the external sensor (step S121). Next, the diagnosis section 52 determines whether the acquired detection data falls within a normal range (step S123). The normal range of the detection data is set as a detection range that is assumed in advance, for example.

If the detection data falls within the normal range (S123/Yes), the diagnosis section 52 updates a reference value of the detection data of the external sensor used for collision determination control to the detection data that is acquired this time (step S125). Next, the diagnosis section 52 sets a state of the external sensor to a "normal detection state" (step S127).

Then, the diagnosis section 52 determines whether the state of the external sensor is changed from a "failure detection state" to the "normal detection state" this time (step S129). If the state of the external sensor is not changed from the "failure detection state" to the "normal detection state", that is, if the state of the external sensor remains the "normal detection state" from the last time (S129/No), the diagnosis section 52 allows the processing to proceed to step S135.

On the other hand, if the state of the external sensor is changed from the "failure detection state" to the "normal detection state" this time (S129/Yes), the diagnosis section 52 issues the event recording request due to the "normal detection state" of the external sensor (step S131). Next, the diagnosis section 52 initializes a timer T1 that measures duration of the "normal detection state" of the external sensor (step S133), and the processing proceeds to step S135.

In step S135, the diagnosis section 52 determines whether the timer T1 that measures the duration of the "normal detection state" of the external sensor elapses specified duration T1_0 that is set in advance (step S135). If the timer T1 does not elapse the specified duration T1_0 (S135/No), the diagnosis section 52 terminates the external sensor failure diagnostic processing. On the other hand, if the timer T1 elapses the specified duration T1_0 (S135/Yes), the diagnosis section 52 sets the state of the external sensor to a "normal confirmation state" (step S137).

Next, the diagnosis section 52 determines whether the state of the external sensor is changed from a "failure confirmation state" to the "normal confirmation state" this time (step S139). If the state of the external sensor is not changed from the "failure confirmation state" to the "normal confirmation state", that is, the state of the external sensor remains the "normal confirmation state" from the last time (S139/No), the diagnosis section 52 terminates the external sensor failure diagnostic processing.

On the other hand, if the state of the external sensor is changed from the "failure confirmation state" to the "normal confirmation state" this time (S139/Yes), the diagnosis section 52 issues the event recording request due to the "normal confirmation state" of the external sensor (step S141). Next, the diagnosis section 52 executes processing to record the diagnostic trouble code (DTC) that corresponds to normal state recovery of the external sensor in the storage section 57 (step S143), and terminates the external sensor failure diagnostic processing. At this time, the past failure record of the external sensor is kept.

If the detection data falls out of the normal range in above-described step S123 (S123/No), the diagnosis section 52 updates the reference value of the detection data of the external sensor that is used for the collision determination control to zero (step S145). Next, the diagnosis section 52 sets the state of the external sensor to the "failure detection state" (step S147).

Next, the diagnosis section 52 determines whether the state of the external sensor is changed from the "normal detection state" to the "failure detection state" this time (step S149). If the state of the external sensor is not changed from the "normal detection state" to the "failure detection state", that is, if the state of the external sensor remains the "failure detection state" from the last time (S149/No), the diagnosis section 52 allows the processing to proceed to step S155.

On the other hand, if the state of the external sensor is changed from the "normal detection state" to the "failure detection state" this time (S149/Yes), the diagnosis section 52 issues the event recording request due to the "failure detection state" of the external sensor (step S151). Next, the diagnosis section 52 initializes a timer T2 that measures duration of the "failure detection state" of the external sensor (step S153), and the processing proceeds to step S155.

In step S155, the diagnosis section 52 determines whether the timer T2 that measures the duration of the "failure detection state" of the external sensor elapses specified duration T2_0 that is set in advance (step S155). If the timer T2 does not elapse the specified duration T2_0 (S155/No), the diagnosis section 52 terminates the external sensor failure diagnostic processing. On the other hand, if the timer T2 elapses the specified duration T2_0 (S155/Yes), the diagnosis section 52 sets the state of the external sensor to the "failure confirmation state" (step S157).

Next, the diagnosis section 52 determines whether the state of the external sensor is changed from the "normal confirmation state" to the "failure confirmation state" this time (step S159). If the state of the external sensor is not changed from the "normal confirmation state" to the "failure confirmation state", that is, the state of the external sensor remains the "failure confirmation state" from the last time (S159/No), the diagnosis section 52 terminates the external sensor failure diagnostic processing.

On the other hand, if the state of the external sensor is changed from the "normal confirmation state" to the "failure confirmation state" this time (S159/Yes), the diagnosis section 52 issues the event recording request due to the "failure confirmation state" of the external sensor (step S161). Next, the diagnosis section 52 executes processing to record the diagnostic trouble code (DTC) that corresponds to the "failure confirmation state" of the external sensor in the storage section 57 (step S163), and terminates the external sensor failure diagnostic processing.

FIG. 9 is a flowchart of one example of message communication disruption diagnostic processing as another example of the diagnosis during the normal time. First, the diagnosis section 52 in the airbag ECU 50*a* determines whether a specified message is received (step S171). If the message is received (S171/Yes), the diagnosis section 52 retrieves the message and executes reception processing (step S173).

Next, the diagnosis section 52 initializes a timer T3 that measures duration of a disruption state of the message (step S175). Then, the diagnosis section 52 sets a disruption diagnostic state to a "normal state" (step S177). Next, the diagnosis section 52 determines whether the disruption diagnostic state is changed from a "failure state" to the "normal state" this time (step S179).

If the disruption diagnostic state is not changed from the "failure state" to the "normal state", that is, the disruption diagnostic state remains the "normal state" from the last time (S179/No), the diagnosis section 52 terminates the message communication disruption diagnostic processing.

On the other hand, if disruption diagnostic state is changed from the "failure state" to the "normal state" this time (S179/Yes), the diagnosis section 52 issues the event recording request for normal recovery of the communication disruption (step S181). Furthermore, the diagnosis section 52 executes processing to record the diagnostic trouble code (DTC) that corresponds to the normal recovery of the communication disruption in the storage section 57 (step S183), and terminates the message communication disruption diagnostic processing.

On the other hand, if the message is not received in above-described step S171 (S171/No), the diagnosis section 52 determines whether the timer T3 that measures the duration of the disruption state of the message elapses specified duration T3_0 that is set in advance (step S185).

If the timer T3 does not elapse the specified duration T3_0 (S185/No), the diagnosis section 52 terminates the message communication disruption diagnostic processing. On the other hand, if the timer T3 elapses the specified duration T3_0 (S185/Yes), the diagnosis section 52 sets the disruption diagnostic state to the "failure state" (step S187).

Next, the diagnosis section 52 determines whether the disruption diagnostic state is changed from the "normal state" to the "failure state" this time (step S189). If the disruption diagnostic state is not changed from the "normal state" to the "failure state", that is, the disruption diagnostic state remains the "failure state" from the last time (S189/No), the diagnosis section 52 terminates the message communication disruption diagnostic processing.

On the other hand, if disruption diagnostic state is changed from the "normal state" to the "failure state" this time (S189/Yes), the diagnosis section 52 issues the event recording request for communication disruption failure (step S191). Furthermore, the diagnosis section 52 executes processing to record the diagnostic trouble code (DTC) that corresponds to the communication disruption failure in the storage section 57 (step S193), and terminates the message communication disruption diagnostic processing.

(Event Recording Data Collection Processing)

Returning to FIG. 6, after the termination of the diagnostic processing during the normal time (S105), the event information acquisition section 53 in the airbag ECU 50*a* executes processing to collect event recording data (step S107). The event recording data is data on the vehicle state before and after time at which the event recording request is issued, an operation condition by the user, and the like, and is stored in the non-volatile memory 160 with the information of the detected event.

FIG. 10 is a flowchart of a specific example of processing to collect the event recording data. First, the event information acquisition section 53 in the airbag ECU 50*a* records brake pedal operation information that is received via the CAN communication line 15 in the storage section 57 (step S201). The storage section 57 may be a ring buffer, for example.

Next, the event information acquisition section 53 records steering angle information that is received via the CAN communication line 15 in the storage section 57 (step S203). Then, the event information acquisition section 53 records engine speed information that is received via the CAN communication line 15 in the storage section 57 (step S205).

Next, the event information acquisition section 53 records ignition switch voltage data in the storage section 57 (step S207). Then, the event information acquisition section 53 records accelerator pedal operation amount information that is received via the CAN communication line 15 in the storage section 57 (step S209).

Next, the event information acquisition section 53 records a sleep state of the airbag ECU 50*a* in the storage section 57 (step S211). Then, the event information acquisition section 53 records vehicle speed information in the storage section 57 (step S213).

The event information acquisition section 53 executes a series of these types of the processing and repeatedly executes event recording data collection processing. Note that a recording order of the various types of the collected data is not limited to that in the above example and may appropriately be switched.

(Event Notification Request Determination and Event Recording Request Message Transmission Processing)

Returning to FIG. 6, after the termination of the event recording data collection processing (S107), the event processing section 55 in the airbag ECU 50*a* determines whether the event notification request is issued. If the event notification request is issued, the event processing section 55 executes processing to transmit the message containing the event recording request to each of the body control ECU 50*b*, the light control ECU 50*c*, and the meter control ECU 50*d* (step S109).

FIG. 11 is a flowchart of a specific example of the processing in step S109. First, the event processing section 55 in the airbag ECU 50*a* determines presence or absence of the event notification request (step S221). If the event notification request is absent (S221/No), the event processing section 55 terminates the processing.

On the other hand, if the event notification request is present (S221/Yes), the event processing section 55 determines whether the event for which the event notification request is issued is set as a target, the recording request of which should be transmitted to each of the body control ECU 50*b*, the light control ECU 50*c*, and the meter control ECU 50*d* (step S223).

If the event for which the event notification request is issued is set as the target, the recording request of which should be transmitted to each of the body control ECU 50*b*, the light control ECU 50*c*, and the meter control ECU 50*d* (S223/Yes), the event processing section 55 further determines whether the transmission of the recording request of the event to each of the body control ECU 50*b*, the light control ECU 50*c*, and the meter control ECU 50*d* is permitted (step S225).

In each of above steps S223 and S225, the event processing section 55 makes the determination in accordance with the setting example in FIG. 4, for example. For example, when the event is included in the setting example illustrated in FIG. 4, the event processing section 55 determines "Yes" in step S223. In this case, in accordance with whether the processing mode of the airbag ECU 50*a* is set to the market mode or any of the processing modes other than the market mode, the event processing section 55 refers to a column of the market mode or a column of other than the market mode in a column of the host control unit to determine propriety of the transmission in step S225.

If the determination of "No" is made in step S223 or step S225 (S223/No or S225/No), the processing proceeds to step S231, and the event processing section 55 executes completion processing of the event notification request processing (step S231) and terminates the processing.

If the transmission of the recording request of the event, for which the event notification request is issued, to each of the body control ECU 50*b*, the light control ECU 50*c*, and the meter control ECU 50*d* is permitted (S225/Yes), the event processing section 55 sets data to be notified to each of the body control ECU 50*b*, the light control ECU 50*c*, and the meter control ECU 50*d* (step S227), and the data includes the recording request.

Next, the event processing section 55 transmits the message including the set data to each of the body control ECU 50*b*, the light control ECU 50*c*, and the meter control ECU 50*d* via the CAN communication line 15 (step S229), executes the completion processing of the event notification request processing (step S231), and terminates the processing.

(Event Recording Processing)

Returning to FIG. 6, the event processing section 55 in the airbag ECU 50*a* records the event data that includes the information of the detected event in the non-volatile memory 160 provided in the airbag ECU 50*a* of itself (step S111).

FIG. 12 is a flowchart of a specific example of processing in which the event processing section 55 in the airbag ECU 50*a* records the event in the non-volatile memory 160 of itself. First, the event processing section 55 determines presence or absence of the event recording request (step S241). If the event recording request is absent (S241/No), the event processing section 55 terminates the event recording processing.

On the other hand, if the event recording request is present (S241/Yes), the event processing section 55 determines whether the event for which the event recording request is issued is set as a target to be recorded in the non-volatile memory 160 (step S243).

If the event as the target of the event recording request is set as the target to be recorded in the non-volatile memory 160 (S243/Yes), the event processing section 55 further determines whether recording of the event in the non-volatile memory 160 is permitted (step S245).

Whether the event, for which the event recording request is issued, is set as the target to be recorded in the non-volatile memory 160 and whether recording of the event in the non-volatile memory 160 is permitted are determined with reference to information that is set in advance.

If the determination is "No" in step S243 or step S245 (S243/No or S245/No), the processing proceeds to step S249, and the event processing section 55 executes completion processing of the event recording request (step S249) and terminates the event recording processing.

If recording of the event, for which the event recording request is issued, in the non-volatile memory 160 is permitted (S245/Yes), the event processing section 55 records the collected event recording data and the information of the detected event in the non-volatile memory 160 (step S247).

Next, the event processing section 55 executes the completion processing of the event recording request (step S249) and terminates the event recording processing.

(Warning Lamp Turn-On Processing)

Returning to FIG. 6, after the termination of the event recording processing (S111), the event processing section 55 in the airbag ECU 50*a* executes processing to transmit a signal that turns on the warning lamp 201 (step S113).

FIG. 13 is a flowchart of a specific example of warning lamp turn-on processing. First, the event processing section 55 determines whether the failure record is included in the diagnostic trouble code (DTC) (step S251). If the failure record is included in the diagnostic trouble code (DTC) (S251/Yes), the event processing section 55 sets a message containing control data that requests turn-on of the warning lamp 201 (step S253).

On the other hand, if the failure record is not included in the diagnostic trouble code (DTC) (S251/No), the event processing section 55 sets a message containing control data that requests turn-off of the warning lamp 201 (step S255).

After setting the message in step S253 or step S255, the event processing section 55 transmits the message containing warning lamp control data onto the CAN communication line 15 (step S257). In this way, the meter control ECU 50*d* that controls display of the meter panel receives the message and turns on or turns off the warning lamp 201.

Thereafter, the processing returns to step S105 in which the diagnostic processing during the normal time is executed, and each of the processing in step S105 to step S113 is repeatedly executed.

3-2. Operation Example of Other Control Units

FIG. 14 is a flowchart of one example of a processing operation that is executed by each of the body control ECU 50*b*, the light control ECU 50*c*, and the meter control ECU 50*d* in the airbag control system 1000.

In this implementation, the airbag ECU 50*a* that has detected the event transmits the message containing the recording request to each of the body control ECU 50*b*, the light control ECU 50*c*, and the meter control ECU 50*d* only for the event, for which the transmission of the event recording request is required.

Accordingly, in the case where each of the body control ECU 50*b*, the light control ECU 50*c*, and the meter control ECU 50*d* receives the message containing the recording request, each of the body control ECU 50*b*, the light control ECU 50*c*, and the meter control ECU 50*d* executes processing to write the event data in the non-volatile memory of the storage section 57 therein.

More specifically, when the event information acquisition section 53 in each of the body control ECU 50*b*, the light control ECU 50*c*, and the meter control ECU 50*d* receives the message containing the event recording request (step S25), the event processing section 55 records the received event data and the identifier of the airbag ECU 50*a* in the non-volatile memory of the storage section 57 (step S27).

At this time, the event processing section 55 may also record an operation state of corresponding one of the body control ECU 50*b*, the light control ECU 50*c*, and the meter control ECU 50*d* at the time of receiving the message containing the event recording request. The operation state of each of the body control ECU 50*b*, the light control ECU 50*c*, and the meter control ECU 50*d* is a stop state, an initialized state, or a normal drive state of each of the body control ECU 50*b*, the light control ECU 50*c*, and the meter control ECU 50*d*, for example.

Just as described, in the case where each of the body control ECU 50*b*, the light control ECU 50*c*, and the meter control ECU 50*d* receives the message containing the event recording request from the airbag ECU 50*a* that has detected the event, each of the body control ECU 50*b*, the light control ECU 50*c*, and the meter control ECU 50*d* records the event data and the operation state of itself at the time. In this way, unintended event data is neither recorded nor accumulated in the non-volatile memory of the storage section 57 in each of the body control ECU 50*b*, the light control ECU 50*c*, and the meter control ECU 50*d*.

Therefore, the workload of deleting the event data that is recorded in any of the processing modes other than the market mode can be reduced. Meanwhile, the event data that is recorded in each of the body control ECU 50*b*, the light control ECU 50*c*, and the meter control ECU 50*d* can be used for a detailed analysis of a situation at the time of the occurrence of the event.

3-3. Setting Example of Processing Mode

Next, a description will be made on several examples of processing in which the mode setting section 51 in each of the control units 50 sets the processing mode to the market mode.

3-3-1. First Example

A first example is an example in which the processing mode is set to the market mode by using an external device such as an ECU tester that is connected via the CAN communication line 15. FIG. 15 is a flowchart of a first example of processing mode setting processing.

For example, as illustrated in FIG. 20, the ECU tester 90 may be connected to the control network 10 via the OBD connector 91, and a processing mode setting request may be transmitted to each of the control units 50 on the basis of operation input by the user. Alternatively, the ECU tester 90 may directly be connected to each of the control units 50, and the processing mode setting request may be transmitted to each of the control units 50 on the basis of the operation input by the user.

In the first example, when the user inputs an operation to set the processing mode of each of the control units 50 to the market mode by using the ECU tester 90, the mode setting section 51 in each of the control units 50 acquires a message or a signal that requests setting to the market mode (step S51).

Next, the mode setting section 51 sets the processing mode to the market mode (step S53). Note that setting of the processing mode to the market mode may be cancellation of setting of any of the processing modes other than the market mode.

3-3-2. Second Example

A second example is an example in which the processing mode is set to the market mode on the basis of the event that is detected by the airbag ECU 50*a* as the host control unit. FIG. 16 is a flowchart of a second example of the processing mode setting processing.

For example, in the case where each of the failure diagnostic results by the airbag ECU 50*a* is detected to be failure recovery at the final stage of the vehicle assembly process or upon the completion of the repair maintenance work of the vehicle, the mode setting section 51 may set the processing mode to the market mode.

In the second example, when the event information acquisition section 53 detects a specified event (step S61), the mode setting section 51 determines whether the detected event is an event that is associated with a market mode setting request (step S63).

For example, in the case where the detected event is a failure absence confirmation event that is a diagnostic result of the absence of the failure at the final stage of the vehicle assembly process, the mode setting section 51 determines that the event is associated with the market mode setting request.

If the detected event is not the event that is associated with the market mode setting request (S63/No), the mode setting section 51 maintains setting of the current processing mode and terminates the processing.

On the other hand, if the detected event is the event that is associated with the market mode setting request (S63/Yes), the mode setting section 51 determines whether the currently set processing mode differs from the market mode (step S65).

If the processing mode is currently set to the market mode (S65/No), the mode setting section 51 maintains setting of the market mode and terminates the processing. On the other hand, if the current processing mode is not the market mode (S65/Yes), the mode setting section 51 sets the processing mode to the market mode and terminates the processing (step S67).

At this time, the airbag ECU 50*a* may transmit a message containing a request to set the processing mode to the market mode to each of the body control ECU 50*b*, the light control ECU 50*c*, and the meter control ECU 50*d*. Note that, similar to the first example, setting of the processing mode to the market mode may be the cancellation of setting of any of the processing modes other than the market mode.

3-3-3. Third Example

A third example is an example in which each of the control units 50 sets the processing mode to the market mode on the basis of a message received from any of other control units 50. FIG. 17 is a flowchart of a third example of the processing mode setting processing.

For example, the message that is transmitted from any of the control units 50 in the control network 10 at the final stage of the vehicle assembly process or upon the completion of the repair maintenance work of the vehicle may contain the signal that requests setting to the market mode, and the control unit 50 that receives the message may set the processing mode to the market mode.

The third example may be an example of the processing that is executed by each of the body control ECU 50*b*, the light control ECU 50*c*, and the meter control ECU 50*d* in the case where the airbag ECU 50*a* in the second example transmits the message containing the request to set the processing mode to the market mode to each of the body control ECU 50*b*, the light control ECU 50*c*, and the meter control ECU 50*d*.

For example, when the event information acquisition section 53 in each of the body control ECU 50*b*, the light control ECU 50*c*, and the meter control ECU 50*d* receives the message from the airbag ECU 50*a* (step S71), the mode setting section 51 determines whether the received message contains the market mode setting request (step S73).

If the received message does not contain the market mode setting request (S73/No), the mode setting section 51 maintains setting of the current processing mode and terminates the processing. On the other hand, if the received message contains the market mode setting request (S73/Yes), the mode setting section 51 determines whether the currently set processing mode differs from the market mode (step S75).

If the processing mode is currently set to the market mode (S75/No), the mode setting section 51 maintains setting of the market mode and terminates the processing. On the other hand, if the current processing mode is not the market mode (S75/Yes), the mode setting section 51 sets the processing mode to the market mode and terminates the processing (step S77).

Note that, similar to the first example, setting of the processing mode to the market mode may be the cancellation of setting of any of the processing modes other than the market mode.

Note that the market mode setting processing by the mode setting section 51 is not limited to the first example to the third example described above. In addition, the mode setting section 51 may execute the market mode setting processing by combining the first example to the third example described above and another example.

3-4. Effects

As it has been described so far, in the airbag control system 1000 according to this implementation, when the airbag ECU 50*a* detects the event, the necessity/unnecessity of transmitting at least some of the event recording requests to each of the body control ECU 50*b*, the light control ECU 50*c*, and the meter control ECU 50*d* is switched depending on whether the processing mode is set to the market mode.

More specifically, in the case where the processing mode is set to the market mode, the airbag ECU 50*a* transmits the event data recording request to each of the body control ECU 50*b*, the light control ECU 50*c*, and the meter control ECU 50*d*. On the other hand, in the case where the processing mode is not set to the market mode, the airbag ECU 50*a* does not transmit at least some of the event recording requests to each of the body control ECU 50*b*, the light control ECU 50*c*, and the meter control ECU 50*d*.

In this way, the unintended event data is not recorded in each of the body control ECU 50*b*, the light control ECU 50*c*, and the meter control ECU 50*d* at the vehicle manufacturing stage or during the repair maintenance work of the vehicle. Thus, the workload of deleting the event data records at the time of the delivery of the vehicle to the market or to an owner can be reduced.

FIG. 18 is a chart illustrating an event data recording period of each of the body control ECU 50*b*, the light control ECU 50*c*, and the meter control ECU 50*d* according to this implementation. In the case of the body control ECU 50*b*, the light control ECU 50*c*, and the meter control ECU 50*d* according to this implementation, even when the airbag ECU 50*a* detects the event at the vehicle manufacturing stage, the message containing the recording request is not transmitted for some or all of the events.

In this way, the unintended event data records are not accumulated in each of the body control ECU 50*b*, the light control ECU 50*c*, and the meter control ECU 50*d*. Thus, when manufacturing of the vehicle is completed and the vehicle is delivered, the task of deleting the unintended event data that is accumulated in each of the body control ECU 50*b*, the light control ECU 50*c*, and the meter control ECU 50*d* is unnecessary.

Similarly, during the maintenance of the vehicle or the repair maintenance work of the vehicle, the unintended event data records are not accumulated in each of the body control ECU 50*b*, the light control ECU 50*c*, and the meter control ECU 50*d*, and thus the task of deleting the unintended event data that is accumulated in each of the body control ECU 50*b*, the light control ECU 50*c*, and the meter control ECU 50*d* is unnecessary. Therefore, time required for the event data deletion work is eliminated, and the manufacturing cost or the repair cost can be reduced.

4. Second Implementation

In the airbag control system 1000 according to a second implementation, the airbag ECU 50*a* transmits the event recording request to each of the body control ECU 50*b*, the light control ECU 50*c*, and the meter control ECU 50*d* regardless of the processing mode, and each of the body control ECU 50*b*, the light control ECU 50*c*, and the meter control ECU 50*d* that has received the recording request switches the necessity/unnecessity of recording the event data in accordance with the processing mode.

4-1. Processing Operation of Airbag ECU

In the airbag control system 1000 according to this implementation, the airbag ECU 50*a* as the host control unit basically executes processing in accordance with the flowchart illustrated in FIG. 6. However, in step S109, the airbag ECU 50*a* transmits the message containing the event recording request to each of the body control ECU 50*b*, the light control ECU 50*c*, and the meter control ECU 50*d* without determining the presence or the absence of the event notification request.

4-2. Processing Operation of Other Control Units

FIG. 19 is a flowchart of one example of a processing operation that is executed by each of the body control ECU 50*b*, the light control ECU 50*c*, and the meter control ECU 50*d* in the airbag control system 1000 according to this implementation.

When the event information acquisition section 53 in each of the body control ECU 50*b*, the light control ECU 50*c*, and the meter control ECU 50*d* receives the message containing the event recording request from the airbag ECU 50*a* (step S41), the event processing section 55 determines whether the processing mode is set to the market mode (step S43).

If the processing mode is set to the market mode (S43/Yes), the event processing section 55 records the event data and the identifier of the airbag ECU 50*a* in the non-volatile memory of the storage section 57 in each of the body control ECU 50*b*, the light control ECU 50*c*, and the meter control ECU 50*d* and terminates the processing (step S47). At this time, the event processing section 55 may also record the operation state of corresponding one of the body control ECU 50*b*, the light control ECU 50*c*, and the meter control ECU 50*d* at the time when the event is detected.

On the other hand, if the processing mode is not set to the market mode (S43/No), the event processing section 55 determines whether it is necessary to record the event data of the event, for which the recording request is received (step S45).

In each of above steps S43 and S45, the event processing section 55 makes the determination in accordance with the setting example in FIG. 5, for example. In this case, in accordance with whether the processing mode is set to the market mode or any of the processing modes other than the market mode, the event processing section 55 refers to the column of the market mode or the column of other than the market mode to determine the propriety of recording in step S45.

If the event processing section 55 determines that it is necessary to record the event data of the event, for which the recording request is received in step S45 (S45/Yes), the event processing section 55 records the event data and the identifier of the airbag ECU 50*a* in the non-volatile memory of the storage section 57 in each of body control ECU 50*b*, the light control ECU 50*c*, and the meter control ECU 50*d* in accordance with the processing in step S47 above (step S47).

On the other hand, in step S45, if the event processing section 55 determines that it is not necessary to record the event data of the event, for which the recording request is received (S45/No), the event processing section 55 does not record the event data and terminates the event processing. Therefore, the workload of deleting the event data that is recorded in any of the processing modes other than the market mode can be reduced.

Note that any of the examples described in the first implementation can appropriately be adopted as the method of setting the processing mode of each of the control units 50 to the market mode.

4-3. Effects

As it has been described so far, in the airbag control system 1000 according to this implementation, each of the body control ECU 50*b*, the light control ECU 50*c*, and the meter control ECU 50*d* that have received the message containing the event recording request switches the necessity/unnecessity of recording at least some of the event data depending on whether the processing mode is set to the market mode.

More specifically, in the case where the processing mode is set to the market mode, each of the body control ECU 50*b*, the light control ECU 50*c*, and the meter control ECU 50*d* that have received the message containing the event recording request records the event data of the event, for which the recording request is received, in the storage section 57. On the other hand, in the case where the processing mode is not set to the market mode, each of the body control ECU 50*b*, the light control ECU 50*c*, and the meter control ECU 50*d* does not record at least some of the event data.

In this way, similar to the case of the first implementation, the unintended event data is not recorded in each of the body control ECU 50*b*, the light control ECU 50*c*, and the meter control ECU 50*d* at the vehicle manufacturing stage or during the repair maintenance work. Thus, the workload of deleting the event data records at the time of the delivery of the vehicle to the market or to the owner can be reduced. Therefore, an increase in manufacturing hours or repair maintenance work hours and a cost increase, which is resulted from the task of deleting the event data records, can be suppressed.

In addition, also in the airbag control system 1000 according to this implementation, the necessity/unnecessity of recording the event data by each of the body control ECU 50*b*, the light control ECU 50*c*, and the meter control ECU 50*d* is set in accordance with the contents of the detected event.

5. Third Implementation

In the airbag control system 1000 according to a third implementation, the airbag ECU 50*a* that has detected the event switches the necessity/unnecessity of transmitting the message containing the recording request to each of the body control ECU 50*b*, the light control ECU 50*c*, and the meter control ECU 50*d* in accordance with the processing mode.

In addition, in the airbag control system 1000 according to this implementation, each of the body control ECU 50*b*, the light control ECU 50*c*, and the meter control ECU 50*d* that have received the message containing the recording request switches the necessity/unnecessity of recording the event data in accordance with the processing mode.

That is, in the airbag control system 1000 according to this implementation, each of the airbag ECU 50*a* that has detected the event and the body control ECU 50*b*, the light control ECU 50*c*, and the meter control ECU 50*d* that have received the message containing the event recording request switches the processing to record the event data depending on whether the processing mode is set to the market mode.

The processing operation by the airbag ECU 50*a* can be executed in accordance with the flowchart of the processing operation by the airbag ECU 50*a* according to the first implementation illustrated in FIG. 6. The processing operation by each of the body control ECU 50*b*, the light control ECU 50*c*, and the meter control ECU 50*d* can be executed by the flowchart of the processing operation by each of the body control ECU 50*b*, the light control ECU 50*c*, and the meter control ECU 50*d* according to the second implementation illustrated in FIG. 19.

In this implementation, in the case where the processing mode of each of the control units 50 is not set to the market mode, it is possible to appropriately set whether the airbag ECU 50*a* determines to transmit the event recording request or whether each of the body control ECU 50*b*, the light control ECU 50*c*, and the meter control ECU 50*d* determines to record the event data in accordance with the contents of the event.

Similar to the airbag control system 1000 according to the first implementation or the second implementation, also in the airbag control system 1000 according to this implementation, the unintended event data is not recorded in each of the body control ECU 50*b*, the light control ECU 50*c*, and the meter control ECU 50*d* at the vehicle manufacturing stage or during the repair maintenance work of the vehicle. In this way, the workload of deleting the event data records at the time of the delivery of the vehicle to the market or to the owner can be reduced. Therefore, the increase in the manufacturing hours or the repair maintenance work hours or the cost increase, which is resulted from the task of deleting the event data records, can be suppressed.

In addition, in the airbag control system 1000 according to this implementation, it is possible to set whether the airbag ECU 50*a* determines the necessity/unnecessity of the transmission or whether each of the body control ECU 50*b*, the light control ECU 50*c*, and the meter control ECU 50*d* that has received the event recording request determines the necessity/unnecessity of recording in accordance with the contents of the event.

In this way, in the cases where it is desired to store the event records only in the airbag ECU 50*a*, where it is desired to transmit the recording request to each of the body control ECU 50*b*, the light control ECU 50*c*, and the meter control ECU 50*d*, and the like, each of the body control ECU 50*b*, the light control ECU 50*c*, and the meter control ECU 50*d* can determine the necessity/unnecessity of recording the event data. Therefore, the necessity/unnecessity of recording the event data can be switched after the minimum required processing is executed in accordance with the contents of the event.

The preferred embodiments of the invention have been described in detail so far with reference to the accompanying drawings. However, the invention is not limited to such embodiments. It is obvious that a person who has basic knowledge in the technical field to which the invention pertains could have easily arrived at various modification examples and application examples that fall within the scope of the technical idea described in the claims. It is understood that those naturally fall within the technical scope of the invention.

REFERENCE SIGNS LIST

40: Control system for vehicle
50: Control unit
50*a*: Airbag ECU
50*b*: Body control ECU
50*c*: Light control ECU
50*d*: Meter control ECU
50*i*: Passenger seat occupant detection ECU
51: Mode setting section
53: Event information acquisition section
55: Event processing section
57: Storage section
59: Communication section
1000: Airbag control system

The invention claimed is:

1. A control system for a vehicle, the control system comprising:
- a plurality of control units mounted on a vehicle and communicably connected to each other via a network, wherein
  - each of the control units includes a memory, and
  - at least one of the control units is configured to detect an event related to an abnormality in the vehicle;
- a mode setting unit configured to set a processing mode of at least one control unit, wherein the processing mode includes a market mode that is set after the vehicle is manufactured and delivered to the market, and at least one additional mode that is set during repair and maintenance of the vehicle, and an event processing unit
- configured to
  - in response to the at least one control unit detecting the event, transmit a recording request of information of the event when the processing mode is set to market mode.

2. The control system according to claim 1, wherein
- the event processing unit is further configured to
  - in response to the at least one control unit detecting the event, and when the processing mode is set to market mode, execute processing for recording event information related to the event in the memory of another control unit included in the plurality of control units when the processing mode is set to market mode, and
  - prevent recording of the event information in the memory of the other control unit when the processing mode is not set to market mode.

3. The control system according to claim 1, wherein
- the event processing unit is further configured to
  - when the processing mode is set to market mode, transmit the recording request to each of the control units the plurality of control units, and
  - when the processing mode is not set to market mode, prevent transmission of the recording request to each of the control units included the plurality of control units.

4. The control system according to claim 1, wherein
- at least one of the plurality of control units includes the event processing unit and the mode setting unit.

5. A plurality of control units mounted on a vehicle and communicably connected to each other via a network, each of the control units comprising:

a memory;

a mode setting unit configured to set a processing mode of at least one control unit, wherein the processing mode includes a market mode that is set after the vehicle is manufactured and delivered to the market, and at least one additional mode that is set during repair and maintenance of the vehicle, and an event processing unit configured to in response to at least one control unit detecting an event related to an abnormality in the vehicle, record information of the event in the memory when the processing mode is set to market mode, and prevent recording of the information in the memory when the processing mode is not set to market mode.

6. A plurality of control units mounted on a vehicle and communicably connected to each other via a network, each of the control units comprising:

a memory;

a mode setting unit configured to set a processing mode of at least one control unit, wherein the processing mode includes a market mode that is set after the vehicle is manufactured and delivered to the market, and at least one additional mode that is set during repair and maintenance of the vehicle, and an event processing unit an event processing unit configured to in response to at least one control unit detecting an event related to an abnormality in the vehicle, transmit a recording request of information of the event when the processing mode is set to market mode.

* * * * *